US005139919A

United States Patent [19]

Taguchi et al.

[11] Patent Number: 5,139,919

[45] Date of Patent: Aug. 18, 1992

[54] HEAT-DEVELOPABLE COLOR PHOTOGRAPHIC MATERIALS WITH COMBINATION OF ELECTRON TRANSFER AGENT AND PRECURSOR

[75] Inventors: Toshiki Taguchi; Takeshi Nakamine; Ken Kawata; Hiroyuki Hirai, all of Kanagawa, Japan

[73] Assignee: Fuji Photo Film Co., Ltd., Kanagawa, Japan

[21] Appl. No.: 657,937

[22] Filed: Feb. 21, 1991

Related U.S. Application Data

[63] Continuation of Ser. No. 275,198, Nov. 23, 1988, abandoned.

[30] Foreign Application Priority Data

Nov. 26, 1987 [JP] Japan ..... 62-298571

[51] Int. Cl.[5] ..... G03C 5/54; G03C 1/42

[52] U.S. Cl. ..... 430/203; 430/218; 430/223; 430/436; 430/443; 430/566; 430/959; 430/351

[58] Field of Search ..... 430/203, 218, 223, 436, 430/438, 443, 959, 566, 351

[56] References Cited

U.S. PATENT DOCUMENTS

| | | | |
|---|---|---|---|
| 4,139,379 | 2/1979 | Chasman et al. | 430/223 |
| 4,483,919 | 11/1984 | Kobayashi et al. | 430/443 |
| 4,559,290 | 12/1985 | Sawada et al. | 430/223 |
| 4,783,396 | 11/1988 | Nakamura et al. | 430/223 |
| 4,891,304 | 1/1990 | Nakamura | 430/223 |

OTHER PUBLICATIONS

Van de Sande, *Angew. Chem. Ind. Ed. Engl*, 22:191–209 (1983).

*Primary Examiner*—Richard L. Schilling
*Attorney, Agent, or Firm*—Sughrue, Mion, Zinn, Macpeak & Seas

[57] ABSTRACT

A heat-developable color photographic material comprising a support having thereon at least a light-sensitive silver halide, a binder, at least one of an electron-donating agent and a precursor thereof, a reducible dye-forming compound which releases a diffusible dye by reduction and an electron-transferring agent, wherein an electron-transferring agent precursor co-exists together with the electron-transferring agent.

13 Claims, No Drawings

HEAT-DEVELOPABLE COLOR PHOTOGRAPHIC MATERIALS WITH COMBINATION OF ELECTRON TRANSFER AGENT AND PRECURSOR

This is a Continuation of application Ser. No. 07/275,198 filed Nov. 23, 1988, now abandoned.

FIELD OF THE INVENTION

The present invention relates to heat-developable color photographic materials and, in particular, to those which are excellent in the raw stock stability and which may form positive color images of high image density with little stain.

BACKGROUND OF THE INVENTION

Heat-developable photographic materials are known, and the materials as well as methods of processing the same are described in, for example, *Shashin Kogaku no Kiso* (Bases of Photoengineering), Volume of Non-silver Photography, pages 242 to 255 (published by Corona Co., Ltd., 1982) and U.S. Pat. No. 4,500,626.

Numerous methods have been proposed for formation of positive color images by heat-development.

For instance, U.S. Pat. No. 4,559,290 has proposed a method of using a so-called DRR compound in the form of an oxidized compound having no dye-releasing ability together with reducing agent, in which the reducing agent is oxidized in accordance with the exposure of the silver halide in a photographic material by heat-development and the DRR compound is reduced by the remaining reducing agent which has not been oxidized to release a diffusible dye. European Patent 220,746A and Disclosure Bulletin 87-6199 (Disclosure Bulletin, Vol. 12, No. 22) mention a method of forming a positive image by heat-development using a novel compound which may release a diffusible dye by a similar mechanism.

In the positive image-forming method mentioned above where a reducible dye-forming compound is used, in general, an electron-donating agent and an electron-transferring agent are used together as a reducing composition. However, the use of such a combination has been found problematic in that the electron-transferring agent will gradually decompose to be lost during storage. As a result of the decomposition and loss of the electron-transferring agent during storage, the image to be obtained is increasingly stained. In order to overcome the problem, a means of using an electron-transferring agent precursor which is stable during storage is helpful. However, the use of such electron-transferring agent precursor has a drawback in that a color image with sufficient S/N ratio can not be obtained.

SUMMARY OF THE INVENTION

An object of the present invention is to provide a positive heat-developable color photographic material which is excellent in raw stock stability and, more precisely, to provide a heat-developable color photographic material which may form a positive color image of high image density with little stain both immediately after preparation and after storage for a long period of time.

Other objects and effects of the present invention will be apparent from the following description.

The present invention provides a heat-developable color photographic material comprising a support having thereon at least a light-sensitive silver halide, a binder, at least one of an electron-donating agent and a precursor thereof, a reducible dye-forming compound which releases a diffusible dye by reduction and an electron-transferring agent, wherein an electron-transferring agent precursor co-exists together with the electron-transferring agent.

DETAILED DESCRIPTION OF THE INVENTION

In accordance with the present invention, an electron-transferring agent precursor is incorporated into the photographic material together with an electron-transferring agent, whereby the material may form a positive image with high S/N ratio and may have the function of preventing an increase of stains upon storage. Such an effect of raw stock stability could not be attained by the separate use of the electron-transferring agent or the electron-transferring agent precursor alone.

As the electron-transferring agent, any compound capable of being oxidized with a silver halide to form an oxidized product which has an ability of cross-oxidizing the co-existing electron-donating agent may be used in the present invention, and it is desired that the electron-transferring agent for use in the present invention is mobile.

As examples of the electron-transferring agent for use in the present invention, there are hydroquinone, alkyl-substituted hydroquinones such as t-butylhydroquinone and 2,5-dimethylhydroquinone, catechols, pyrogallols, halogen-substituted hydroquinones such as chlorohydroquinone and dichlorohydroquinone, alkoxy-substituted hydroquinones such as methoxyhydroquinone, and polyhydroxybenzene derivatives such as methylhydroxynaphthalene. In addition, there are further mentioned methyl gallate, ascorbic acid, ascorbic acid derivatives, hydroxylamines such as N,N'-di-(2-ethoxyethyl)hydroxylamine, pyrazolidones such as 1-phenyl-3-pyrazolidone and 4-methyl-4-hydroxymethyl-1-phenyl-3-pyrazolidone, aminophenols such as p-methylaminophenol, p-dimethylaminophenol, p-piperidinoaminophenol and 4-dimethylamino-2,6-dimethoxyphenol, phenylenediamines such as N-methyl-p-phenylenediamine, N,N,N',N'-tetramethyl-p-phenylenediamine and 4-diethylamino-2,6-dimethoxyaniline, reductones such as piperidinohexose-reductone and pyrrolidinohexose-reductone, and hydroxytetranic acids. In particular, compounds of the following general formula (X-I) or (X-II) are especially useful as the electron-transferring agent in the present invention.

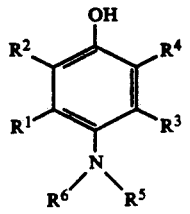

(X-I)

-continued

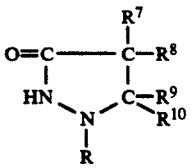

(X-II)

in which R represents an aryl group; and $R^1$, $R^2$, $R^3$, $R^4$, $R^5$, $R^6$, $R^7$, $R^8$, $R^9$, and $R^{10}$, which may be the same or different, each represents a hydrogen atom, a halogen atom, a hydroxyl group, an acylamino group, an alkoxy group, an alkylthio group, an alkyl group, a substituted alkyl group or an aryl group.

In the formulae (X-I) and (X-II), the aryl group for R includes, for example, a phenyl group, a naphthyl group, a tolyl group and a xylyl group which may optionally be substituted. For example, the group may be an aryl group substituted by substituent(s) selected from a halogen atom (e.g., chlorine, bromine), an amino group, an alkoxy group, an aryloxy group, a hydroxyl group, an aryl group, a carbonamido group, a sulfonamido group, an alkanoyloxy group, a benzoyloxy group, a ureido group, a carbamate group, a carbamoyloxy group, a carbonate group, a carboxyl group, a sulfo group and an alkyl group (e.g., methyl, ethyl, propyl).

In the formulae (X-I) and (X-II), the alkyl group for $R^1$, $R^2$, $R^3$, $R^4$, $R^5$, $R^6$, $R^7$, $R^8$, $R^9$, and $R^{10}$ is preferably an alkyl group having from 1 to 10 carbon atoms (e.g., methyl, ethyl, propyl, butyl), and the alkyl group may optionally be substituted by substituent(s) selected from a hydroxyl group, an amino group, a sulfo group and a carboxyl group. As the aryl group, there may be mentioned a phenyl group, a naphthyl group, a xylyl group and a tolyl group, which may optionally be substituted by substituents(s) selected from a halogen atom (e.g., chlorine, bromine), an alkyl group (e.g., methyl, ethyl, propyl), a hydroxyl group, an alkoxy group (e.g., methoxy, ethoxy), a sulfo group and a carboxyl group. In the present invention, the compounds of the formula (X-II) are especially preferred. In the formula (X-II), $R^7$, $R^8$, $R^9$, and $R^{10}$ each are preferably a hydrogen atom, an alkyl group having from 1 to 10 carbon atoms, a substituted alkyl group having from 1 to 10 carbon atoms or a substituted or unsubstituted aryl group, and more preferably a hydrogen atom, a methyl group, a hydroxymethyl group, an unsubstituted phenyl group or a phenyl group substituted by hydrophilic group(s) such as a hydroxyl group, an alkoxy group, a sulfo group and a carboxyl group.

Specific examples of the compounds of the formulae (X-I) and (X-II) are given below, but are not to be construed as limiting the invention.

Specific examples of the compounds of the Formula (X-I)
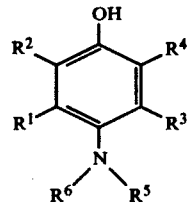
| No. | $R^1$ | $R^2$ | $R^3$ | $R^4$ | $R^5$ | $R^6$ |
|---|---|---|---|---|---|---|
| X-1 | H | H | H | H | H | $-CH_3.\frac{1}{2}H_2SO_4$ |
| X-2 | " | " | " | " | " | 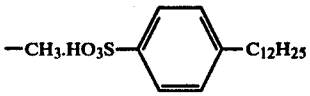 |
| X-3 | " | " | " | " | " | $-CH_3.HCl$ |
| X-4 | " | " | " | " | $-CH_3$ | $-CH_2CH_2NHSO_2CH_3$ |
| X-5 | " | " | " | $-Cl$ | $-CH_3$ | 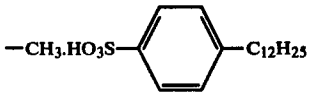 |
| X-6 | " | " | " | $-NHCOCH_3$ | H | $-CH_3.\frac{1}{2}H_2SO_4$ |
| X-7 | " | " | " | $-CH_3$ | $-CH_3$ | 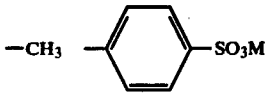 |
| X-8 | $-CH_3$ | " | " | $-CH_3$ | H | $-CH_3$ |
Specific examples of the compounds of the Formula (X-II)
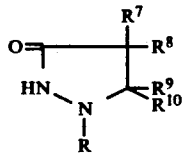
| No. | $R^7$ | $R^8$ | $R^9$ | $R^{10}$ | R |
|---|---|---|---|---|---|

-continued
| | | | | | |
|---|---|---|---|---|---|
| X-9 | H | H | H | H | 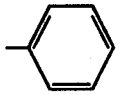 |
| X-10 | $-CH_3$ | $-CH_3$ | " | " | 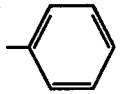 |
| X-11 | $-CH_3$ | $-CH_3$ | " | " | 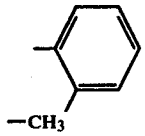 |
| X-12 | $-CH_3$ | $-CH_2OH$ | " | " | 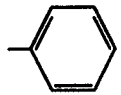 |
| X-13 | H | H | " | " | 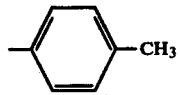 |
| X-14 | $-CH_3$ | $-CH_2OH$ | " | " | 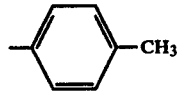 |
| X-15 | $-CH_3$ | $-CH_2OH$ | H | H | 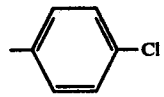 |
| X-16 | $-CH_2OH$ | $-CH_2OH$ | " | " | 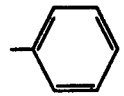 |

-continued
| | | | | | |
|---|---|---|---|---|---|
| X-17 | $-CH_3$ | $-CH_3$ | " | " | 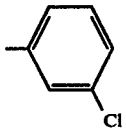 |
| X-18 | $-CH_3$ | $-CH_2OH$ | " | " | 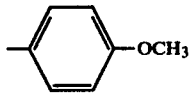 |
| X-19 | $-CH_3$ | $-CH_2OCCH_3$ ‖ O | " | " | 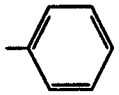 |
| X-20 | $-CH_2OH$ | $-CH_2OH$ | " | " | 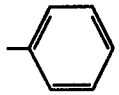 |
| X-21 | $-CH_3$ | $-CH_3$ | " | " | 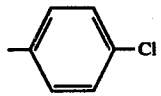 |
| X-22 | $-CH_3$ | $-CH_2OH$ | " | " | 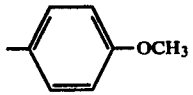 |
| X-23 | $-CH_3$ | $-CH_2OCCH_3$ ‖ O | H | H | 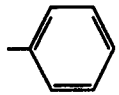 |
| X-24 | " | 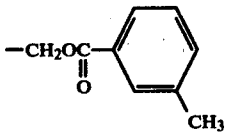 | " | " | " |

-continued
| | | | | | |
|---|---|---|---|---|---|
| X-25 | H | 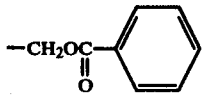 | " | " | " |
| X-26 | " | $-CH_2OC(=O)CH_3$ | " | " | " |
| X-27 | " | 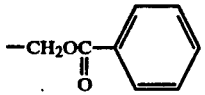 | " | " | 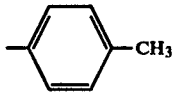 |
| X-28 | $-CH_3$ | 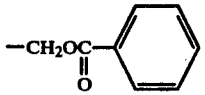 | " | " | 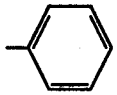 |
| X-29 | $-C_3H_7$ | 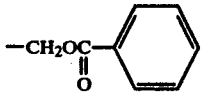 | " | " | 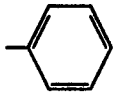 |
| X-30 | H | H | $-CH_3$ | H | 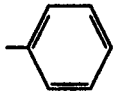 |
| X-31 | " | " | " | $-CH_3$ | " |
| X-32 | " | " | H | 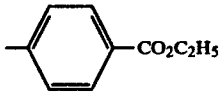 | " |
| X-33 | " | " | " | 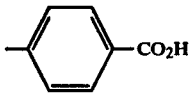 | " |
| X-34 | " | " | " | 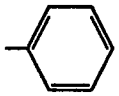 | " |

-continued
| | | | | | |
|---|---|---|---|---|---|
| X-35 | " | " | " | " | 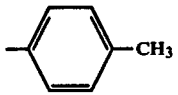 |
| X-36 | " | " | " | " | 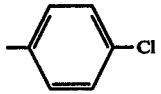 |
| X-37 | " | " | " | " | 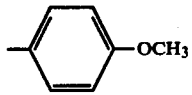 |
| X-38 | H | H | H | 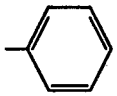 | 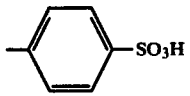 |
| X-39 | " | " | " | 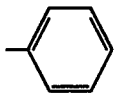 | 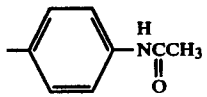 |
| X-40 | " | " | " | " | 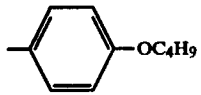 |
| X-41 | " | " | " | " | 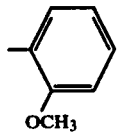 |
| X-42 | " | " | " | 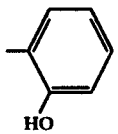 | 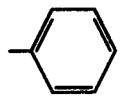 |

-continued
| | | | | | |
|---|---|---|---|---|---|
| X-43 | " | " | " | 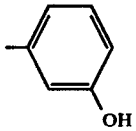 | " |
| X-44 | " | " | " | 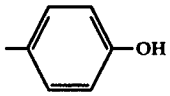 | 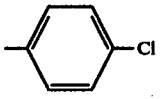 |
| X-45 | " | " | " | 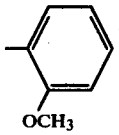 | 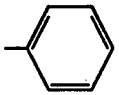 |
| X-46 | H | H | H | 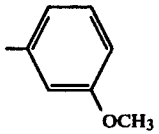 | 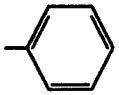 |
| X-47 | " | " | " | 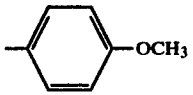 | " |
| X-48 | " | " | " | 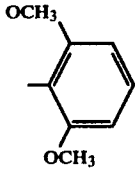 | " |
| X-49 | " | " | " | 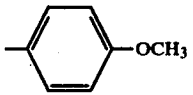 | 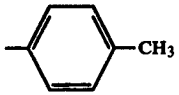 |

-continued
| | | | | | |
|---|---|---|---|---|---|
| X-50 | " | " | " | H | 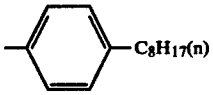 |
| X-51 | " | " | " | " | 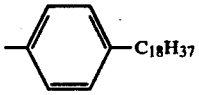 |
| X-52 | " | " | " | 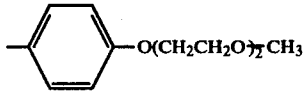 | 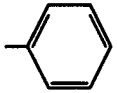 |
| X-53 | H | H | 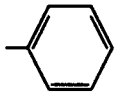 | H | 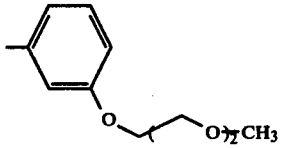 |
| X-54 | " | " | 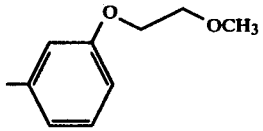 | " | 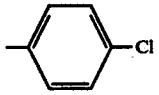 |
| X-55 | " | " | 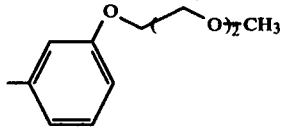 | " | 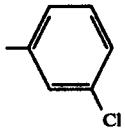 |
| X-56 | " | " | 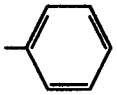 | " | 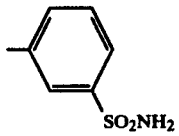 |

-continued
| | | | | | |
|---|---|---|---|---|---|
| X-57 | " | " | 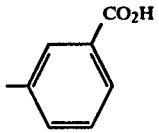 | " | 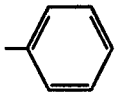 |
| X-58 | " | " | 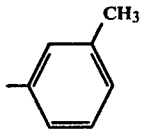 | " | 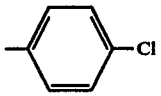 |
| X-59 | H | H | 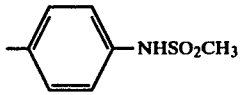 | H | 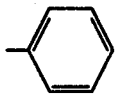 |
| X-60 | " | " | 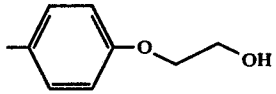 | " | 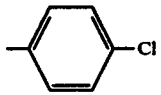 |
| X-61 | " | $-CH_3$ | 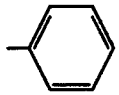 | " | 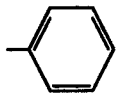 |
| X-62 | $-OH$ | " | | " | 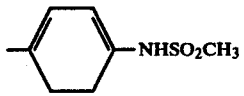 |
| X-63 | H | H | 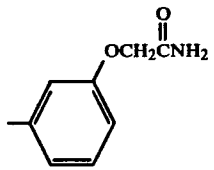 | " | 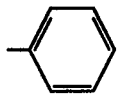 |

-continued
| | | | | | |
|---|---|---|---|---|---|
| X-64 | " | " | 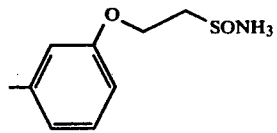 | " | 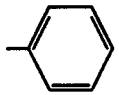 |
| X-65 | H | H | 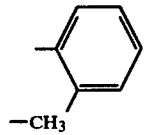 | H | 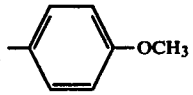 |
| X-66 | $-CH_3$ | $-CH_3$ | H | " | 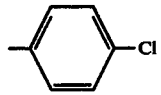 |
| X-67 | H | H | " | " | 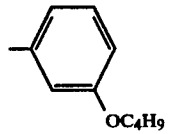 |
| X-68 | " | " | " | " | 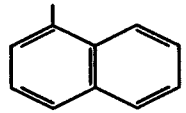 |
| X-69 | $-CH_3$ | $-CH_2OH$ | " | " | " |
| X-70 | " | $-CH_3$ | " | " | " |
| X-71 | " | $-OH$ | " | " | " |
| X-72 | " | H | " | " | " |
| X-73 | H | " | $-CH_3$ | $-CH_3$ | " |
| X-74 | H | H | $-CH_3$ | H | 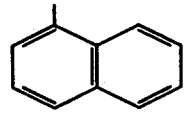 |
| X-75 | $-CH_2OCOCH_3$ | " | H | " | " |
| X-76 | $-CH_2OCOC_6H_5$ | " | " | " | " |
| X-77 | $-CH_2OH$ | $-CH_2OH$ | " | " | " |
| X-78 | $-CH_3$ | $-CH_2OCOCH_3$ | H | " | " |

-continued
| | | | | | |
|---|---|---|---|---|---|
| X-79 | H | H | " | 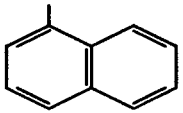 | 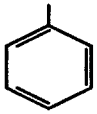 |
| X-80 | $-CH_3$ | $-CH_2OH$ | " | " | " |
| X-81 | $-CH_2OH$ | $-CH_2OH$ | " | " | " |
| X-82 | $-CH_2OH$ | H | " | " | " |
| X-83 | $-CH_3$ | $-OH$ | H | 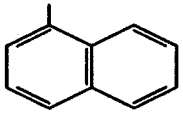 | 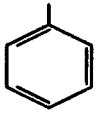 |
| X-84 | " | $-CH_3$ | " | 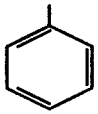 | " |
| X-85 | " | H | " | " | " |
| X-86 | $-CH_2OH$ | " | " | " | " |
| X-87 | $-CH_3$ | $-CH_2OH$ | " | " | " |
| X-88 | $-CH_2OH$ | " | " | " | " |
| X-89 | $-OH$ | H | " | " | " |
| X-90 | $-CH_3$ | $-OH$ | " | " | " |
| X-91 | H | 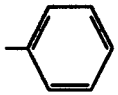 | " | " | " |
| X-92 | H | 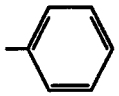 | $-CH_3$ | 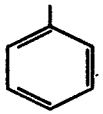 | 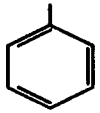 |
| X-93 | $-CH_3$ | " | H | " | " |
| X-94 | $-CH_2OH$ | " | " | " | " |

These electron-transferring agents are known and available in the art.

In accordance with the present invention, the electron-transferring agent may be used in a concentration range that can be determined by the skilled artisan. A suitable concentration range in mols is from 0.001 time to 4 times per mol of silver, and an especially useful concentration range in mol is from 0.003 time to 0.5 time per mol of silver.

As the electron-transferring agent precursor for use in the present invention, there are, for example, 2- or 3-acyl derivatives or 2-aminoalkyl or hydroxyalkyl derivatives of 1-phenyl-3-pyrazolidinone, metal salts (e.g., lead, cadmium, calcium or barium salt) of hydroquinone or catechol, acyl derivatives of hydroquinone, oxazine or bisoxazine derivatives of hydroquinone, lactone-type electron-transferring agent precursors, quaternary ammonium group-containing hydroquinone precursors, cyclohex-2-en-1,4-dione type compounds, as well as compounds capable of releasing an electron-transferring agent by an electron transfer reaction, compounds capable of releasing an electron-transferring agent by an intramolecular nucleophillic substitution reaction, phthalide group-blocked electron-transferring agent precursors and imidomethyl group-blocked electron-transferring agent precursors.

The electron-transferring agent precursors for use in the present invention are known compounds, and for example, the developing agent precursors described in U.S. Pat. Nos. 3,767,704, 3,241,967, 3,246,988, 3,295,978, 3,462,266, 3,586,506, 3,615,439, 3,650,749, 4,209,580, 4,330,617 and 4,310,612, British Patent 1,023,701, 1,231,830, 1,258,924 and 1,346,920, JP-A-55-53330, JP-A-57-40245, JP-A-58-1139, JP-A-58-1140, JP-A-59-93442, JP-A-59-121328, JP-A-59-140445, JP-A-59-178458, JP-A-59-182449 and JP-A-59-182450 (the term "JP-A" as used herein means an "unexamined published Japanese patent application") can be used. In particular, the 1-phenyl-2-pyrazolidinone precursors described in JP-A-55-53330, JP-A-59-140445, JP-A-59-178458, JP-A-59-182449, JP-A-59-182450 and JP-A-62-235949 are especially preferred.

Specific examples of preferred electron-transferring agent precursors for use in the present invention are compounds of the following general formulae (W-I) through (W-III):

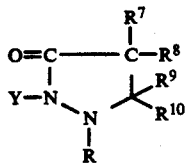

(W-I)

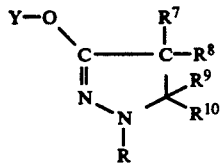

(W-II)

-continued

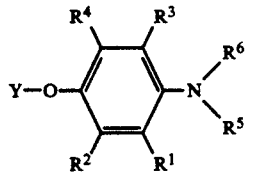

(W-III)

In the formulae (W-I) to (W-III), R and $R^1$ to $R^{10}$ have the same meaning as described above for R and $R^1$ to $R^{10}$ in the general formulae (X-I) and (X-II).

In the formulae (W-I) to (W-III), Y represents a substituted alkyl group, preferably —$CH_2$—K in which K represents a halogen atom, an alkoxy group, an aryloxy group, an acyloxy group, a carbonic acid ester group, an amino group, a carbonamido group, a sulfonamido group, a ureido group, an aminosulfonamido group, a carbamate group, a carboxyl group, an oxycarbonyl group, a carbamoyl group, an acyl group, a sulfo group, an alkylsulfonyl group, an arylsulfonyl group, a sulfamoyl group, a cyano group or a nitro group; an acyl group, an alkoxycarbonyl group; an aryloxycarbonyl group; a carbamoyl group; a substituted carbamoyl group, a sulfamoyl group; a substituted sulfamoyl group; a group having the following formula:

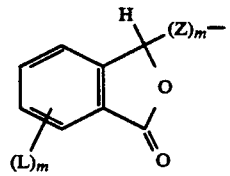

in which Z represents a divalent linking group bonded to the phthalido nucleus via an oxygen atom, L represents a halogen atom, an alkyl group, an alkenyl group, an aryl group, an alkoxy group, an aryloxy group, an acyloxy group, a carbonic acid ester group, an amino group, a carbonamido group, a sulfonamido group, a ureido group, an amino sulfonamido group, a carbamate group, a carboxyl group, an oxycarbonyl group, a carbamoyl group, an acyl group, a sulfo group, an alkylsulfonyl group, an arylsulfonyl group, a sulfamoyl group, a cyano group or a nitro group, and m represents 0 or 1; or a group of the following formula:

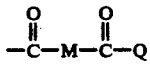

in which M represents

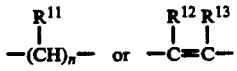

(where n represents 2 or 3, $R^{11}$ represents a hydrogen atom, an alkyl group, a phenyl group, a halogen atom or an alkoxy group, $R^{12}$ and $R^{13}$ each represents a hydrogen atom, a halogen atom, an alkyl group or a phenyl group, or $R^{12}$ and $R^{13}$may be ring-closed to form a benzene ring), and Q represents a hydroxyl group,

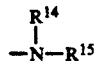

or $R^{16}$ (where $R^{14}$ represents a hydrogen atom, an aryl group or an alkyl group, $R^{15}$ represents a hydrogen atom or an acyl group, and $R^{16}$ represents a hydrolyzable group).

As examples of the hydrolyzable group for $R^{16}$, there are

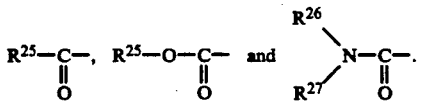

$R^{25}$ represents an aliphatic group having from 1 to 22 carbon atoms, an aromatic group having from 6 to 10 carbon atoms or a heterocyclic group; $R^{26}$ and $R^{27}$ may be the same or different and each represents a hydrogen atom, an aliphatic group having from 1 to 22 carbon atoms, an aromatic group having from 6 to 10 carbon atoms or a heterocyclic group. The aliphatic group for $R^{25}$, $R^{26}$ and $R^{27}$ may be substituted or unsubstituted and may be linear or cyclic.

Preferred substituents for the aliphatic group include, for example, an alkoxy group, an aryloxy group, an acylamino group, a carbamoyl group, a halogen atom, a sulfonamido group, a sulfamoyl group, a carboxyl group, an alkanoyloxy group, a benzoyloxy group, a cyano group, a hydroxyl group, a ureido group, a carbonyl group, an aryl group, an alkylsulfonyl group, an alkoxycarbonyl group, an alkylureido group, an imidazolyl group, a furyl group, a nitro group, a phthalimido group, a thiazolyl group, an alkanesulfonamido group, an alkanesulfamoyl group, an arylcarbonyl group, an imido group and an alkoxycarbonylamino group.

When $R^{25}$, $R^{26}$ or $R^{27}$ represents an aromatic group (especially a phenyl group), the aromatic group may optionally be substituted. The aromatic group such as a phenyl group may be substituted by substituent(s) selected from a halogen atom, a nitro group, a hydroxyl group, a cyano group, a carboxyl group, an alkyl group having 32 or less carbon atoms, an alkenyl group, an alkoxy group, an alkoxycarbonyl group, an alkanoyloxy group, an alkoxycarbonylamino group, an aliphatic amido group, an alkylsulfamoyl group, an alkylsulfonamido group, an alkylureido group, an alkylsulfonyl group and an alkyl-substituted succinimido group. The alkyl moiety in these substituents may have an aromatic group such as a phenylene group in the chain. The phenyl group may optionally be substituted by substituent(s) selected from an aryloxy group, an aryloxycarbonyl group, an arylcarbamoyl group, an arylamido group, an arylsulfamoyl group, an arylsulfonamido group and an arylureido group. The aryl moiety in these substituents may optionally be substituted by one or more alkyl groups having from 1 to 22 carbon atoms in total.

When $R^{25}$, $R^{26}$ or $R^{27}$ represents a heterocyclic group, the heterocyclic group is bonded to the linking group having an auxiliary developing agent, via one carbon atom which constitutes the hetero-ring. Examples of the hetero-ring include thiophene, furan, pyran, pyrrole, pyrazole, pyridine, pirazine, pyrimidine, pyridazine, indolidine, imidazole, thiazole, oxazole, triazine, thiadiazine and oxazine rings. These rings may optionally have substituent(s) thereon.

In the formulae (W-I) to (W-III), the substituent Y may further be substituted by substituent(s) (for example, selected from the substituents mentioned for L in the above).

Specific examples of the substituent Y in the formulae (W-I) to (W-III) are set forth in the following Tables A and B. However, the substituent Y in the electron-transferring agent precursors for use in the present invention are not limited to only these examples.

TABLE A

| No. | Formula | Substituent Y |
|---|---|---|
| 1 | W-I | $-C(=O)-CH_3$ |
| 2 | " | $-CH_2OC(=O)-CH_2-CH_2-C(=O)CH_3$ |
| 3 | " | $-C(=O)-C(=O)-OC_2H_5$ |
| 4 | " | $-CH_2OC(=O)CH_3$ |
| 5 | " | $-CH_2OC(=O)C(=O)OC_2H_5$ |
| 6 | " | 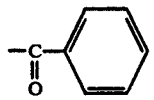 |
| 7 | " | 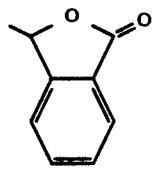 |
| 8 | " | $-C(=O)-CH_2-CH_2-C(=O)CH_3$ |
| 9 | " | $-C(=O)-CH_2-CH_2-C(=O)CH_2F$ |
| 10 | W-I | $-CH_2Cl$ |
| 11 | " | $-CH_2OH$ |
| 12 | " | $-CH_2N(CH_3)-CH_2-CH_2-OH$ |
| 13 | " | $-C(=O)-OCH_2-C_6H_4-OC(=O)CF_3$ |
| 14 | " | $-C(=O)C(CH_3)_3$ |

TABLE A-continued
| No. | Formula | Substituent Y |
|---|---|---|
| 15 | " | 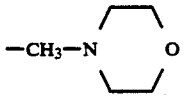 |
| 16 | " | 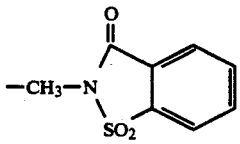 |
| 17 | " | 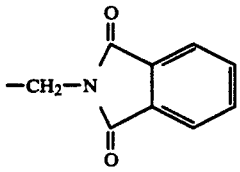 |
| 18 | " | 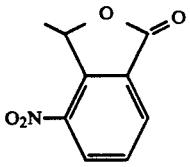 |
| 19 | W-I | 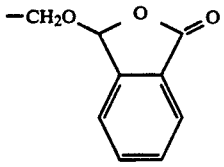 |
| 20 | " | 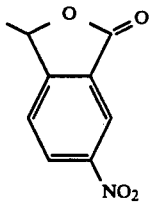 |
| 21 | " | 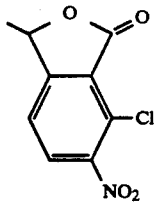 |
| 22 | " | 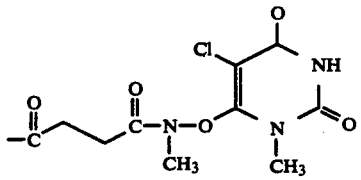 |
| 23 | W-II | 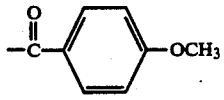 |
| 24 | W-I | 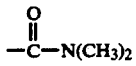 |
TABLE A-continued
| No. | Formula | Substituent Y |
|---|---|---|
| 25 | " | 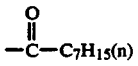 |
| 26 | W-II | 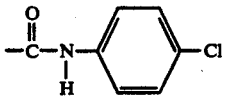 |
| 27 | " | 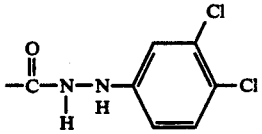 |
| 28 | " | 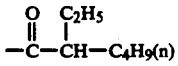 |
| 29 | " | 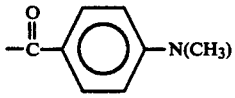 |
| 30 | " | 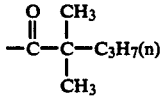 |
| 31 | W-I | 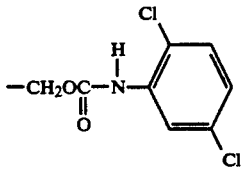 |
| 32 | " | 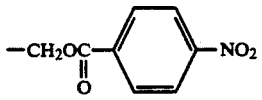 |
| 33 | " | 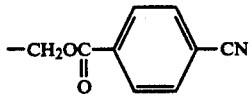 |
| 34 | W-I | 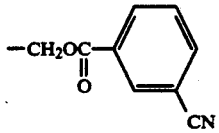 |
| 35 | " | 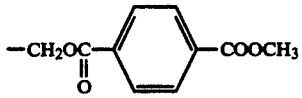 |
| 36 | " | 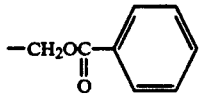 |
| 37 | " | 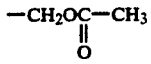 |

TABLE A-continued
| No. | Formula | Substituent Y |
|---|---|---|
| 38 | " | $-CH_2OC(=O)N(CH_3)_2$ |
| 39 | " | 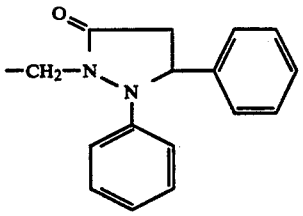 |
| 40 | " | 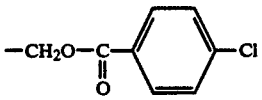 |
| 41 | " | 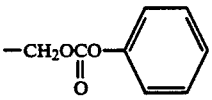 |
| 42 | " | $-CH_2OC(=O)OC_4H_9(n)$ |
| 43 | W-I | 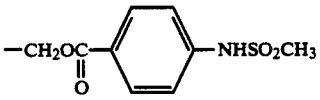 |
| 44 | " | 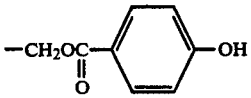 |
| 45 | " | 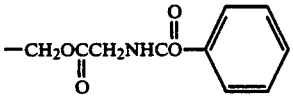 |
| 46 | " | $-CH_2OC(=O)CH_2CH_2Cl$ |
| 47 | " | 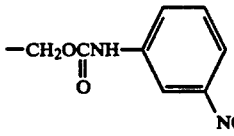 |
| 48 | " | $-C(=O)CH_2CH_2C(=O)-OH$ |
| 49 | " | $-C(=O)CH_2CH_2C(=O)NOH$ $CH_3$ |
| 50 | " | $-C(=O)(CH_2)_3C(=O)-OH$ |
TABLE A-continued
| No. | Formula | Substituent Y |
|---|---|---|
| 51 | W-I | $-C(=O)CH=CHC(=O)-OH$ |
| 52 | " | $-C(=O)CH_2CH(C_{12}H_{25})-COOH$ |
| 53 | W-II | $-C(=O)-OC_4H_9(n)$ |
| 54 | " | $-C(=O)-O-C(CH_3)(C_2H_5)-C_4H_9(n)$ |
| 55 | " | 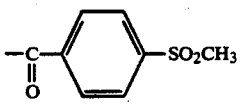 |
| 56 | " | $-C(=O)-C(=O)-OC_2H_5$ |
| 57 | " | $-C(=O)-CH_3$ |
| 58 | " | 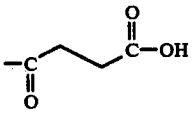 |
| 59 | " | 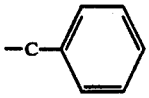 |
| 60 | W-II | $-C(=O)-C(CH_3)_3$ |
| 61 | " | 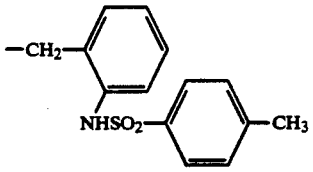 |
| 62 | " | 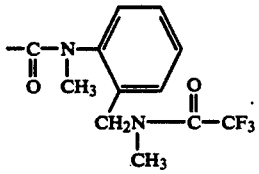 |
| 63 | " | 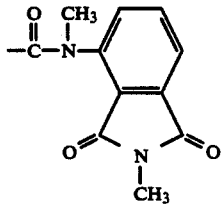 |

TABLE A-continued

| No. | Formula | Substituent Y |
|---|---|---|
| 64 | " | $-\overset{O}{\overset{\|\|}{C}}OC_2H_5$ |
| 65 | " | 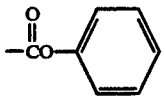 |
| 66 | " | 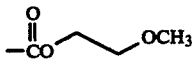 |
| 67 | " | $-\overset{O}{\overset{\|\|}{C}}N(C_2H_5)_2$ |
| 68 | W-II | 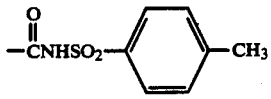 |
| 69 | " | 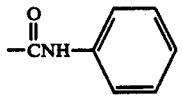 |
| 70 | " | 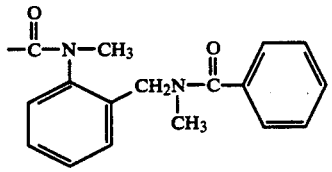 |
| 71 | " | $-\underset{O}{\underset{\|\|}{C}}-C_{13}H_{27}(n)$ |

TABLE B

| No. | Formula | Substituent Y |
|---|---|---|
| 72 | W-III | $-\underset{O}{\underset{\|\|}{C}}-CH_3Cl$ |
| 73 | " | $-\underset{O}{\underset{\|\|}{C}}-CH_3$ |
| 74 | " | 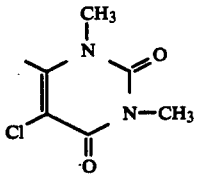 |
| 75 | " | $-\underset{O}{\underset{\|\|}{C}}CH_2CH_2\overset{O}{\overset{\|\|}{C}}CH_3$ |
| 76 | " | $-\underset{O}{\underset{\|\|}{C}}-OC_2H_5$ |

TABLE B-continued

| No. | Formula | Substituent Y |
|---|---|---|
| 77 | " | 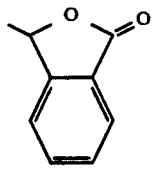 |
| 78 | " | $-CH_2CH_2CN$ |

In accordance with the present invention, compounds produced by properly combining the substituent Y shown in the aforesaid Tables A and B and the above-mentioned electron-transferring agent are used as the electron-transferring agent precursor.

Specific examples of electron-transferring agent precursors for use in the present invention are set forth below, which, however, are not whatsoever limitative.

The symbol and the number for the structural formula of the respective electron-transferring agent precursors mentioned below have the following meanings.

ETP-34-11:

ETP: This means an electron-transferring agent precursor.

34: This means that the precursor releases the aforesaid electron-transferring agent X-34.

11: This means the precursor is protected by the substituent No. 11 in the aforesaid Table A or B.

ETP-34-11

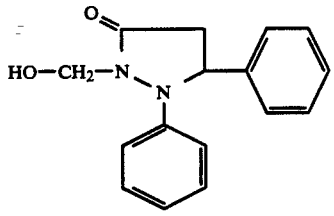

ETP-87-34

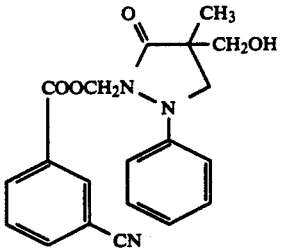

ETP-36-60

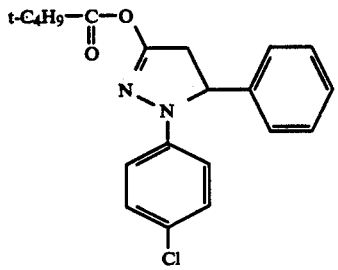

-continued
ETP-34-35
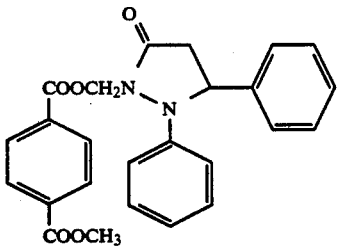
ETP-69-59
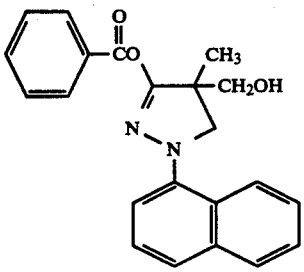
ETP-34-50
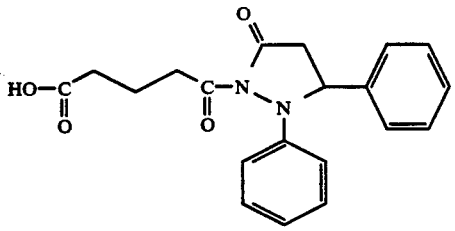
ETP-9-36
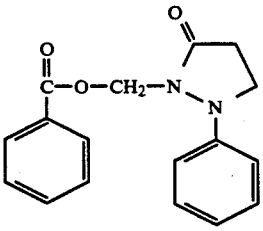
ETP-9-63
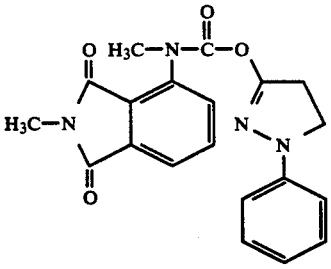
ETP-8-71
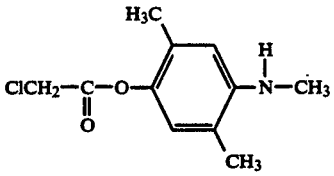
ETP-7-76
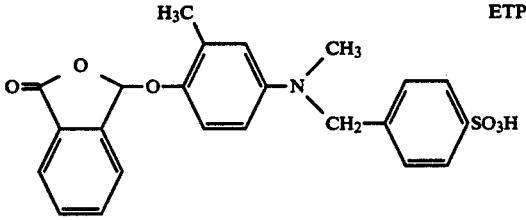
-continued
ETP-15-64
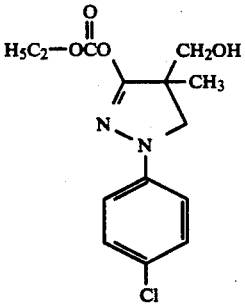
ETP-12-53
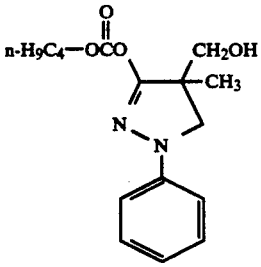
ETP-34-65
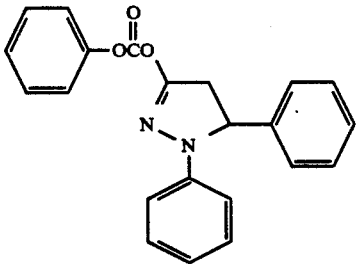
ETP-9-32
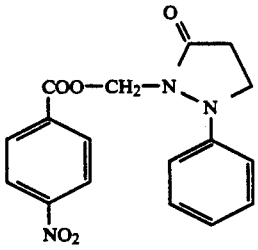
ETP-34-54
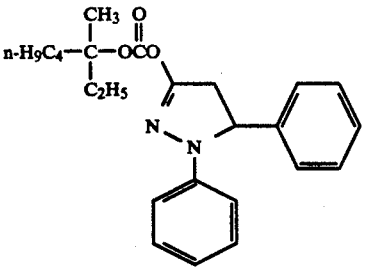
ETP-12-71
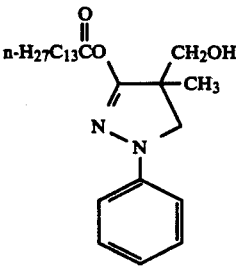

-continued
ETP-46-25
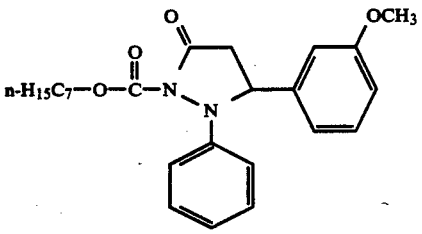
ETP-46-14
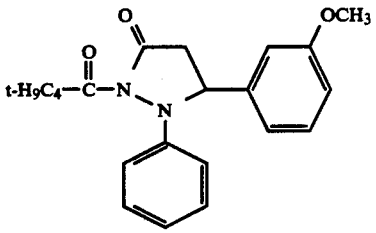
ETP-46-68
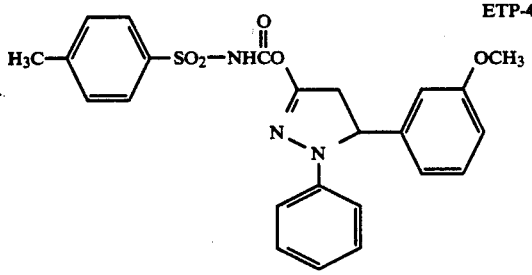
ETP-34-64
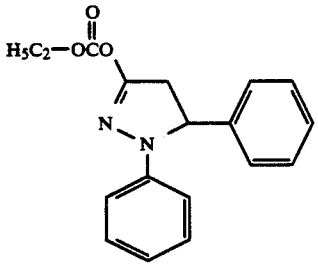
ETP-34-53
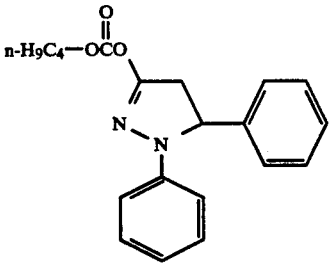
ETP-36-65
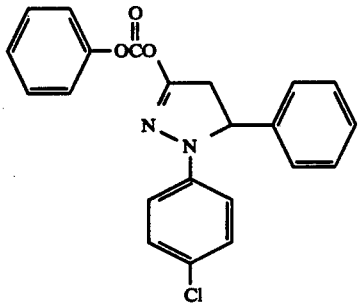
-continued
ETP-35-32
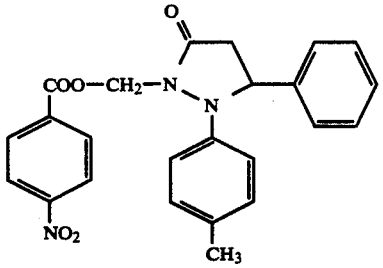
ETP-69-64
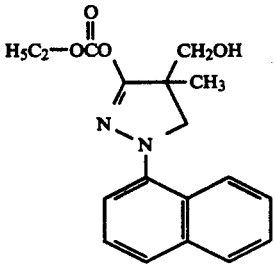
ETP-43-53
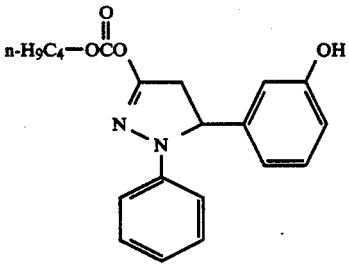
ETP-49-65
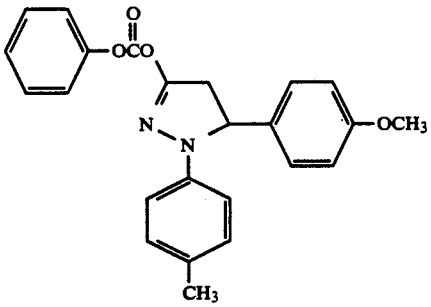
ETP-68-32
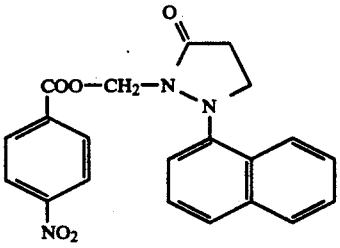
ETP-46-54
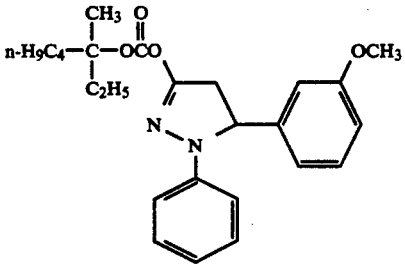

-continued
ETP-68-71
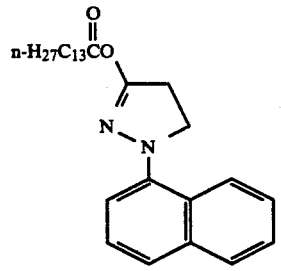
ETP-21-25
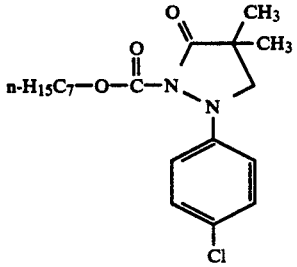
ETP-18-14
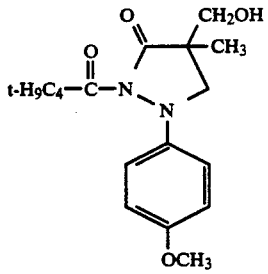
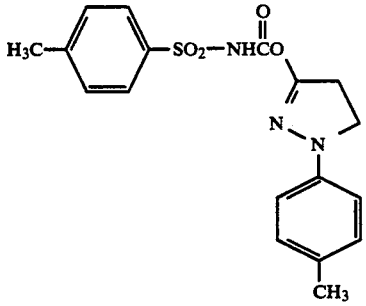
ETP-13-66
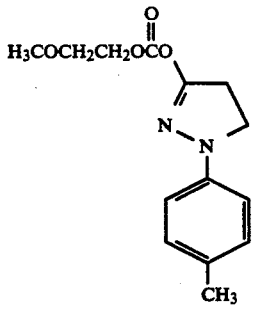
ETP-12-34
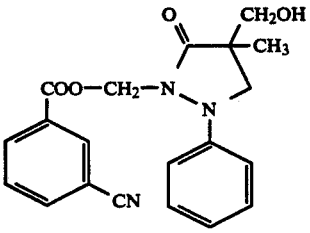
-continued
ETP-36-6
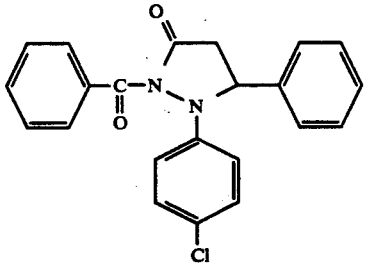
ETP-34-31
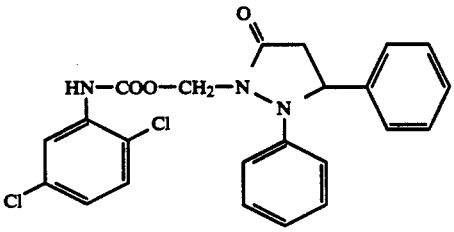
ETP-34-47
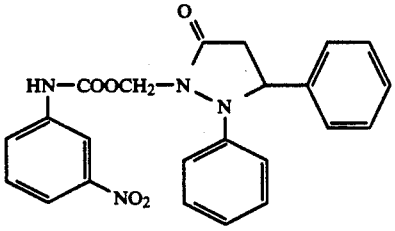
ETP-36-66
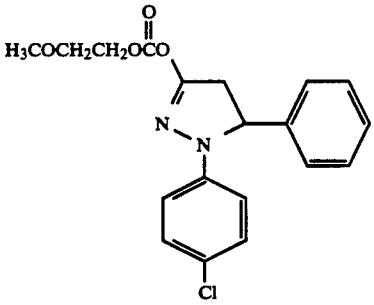
ETP-13-6
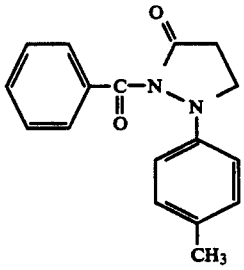
ETP-46-23
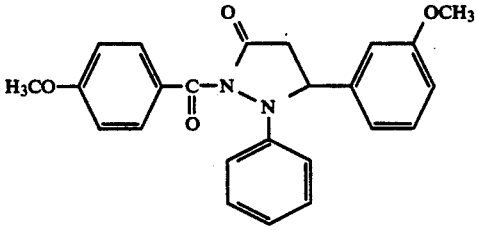

-continued
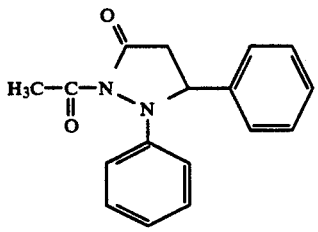
ETP-34-1
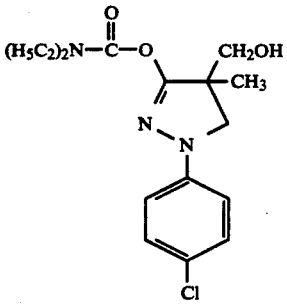
ETP-15-67
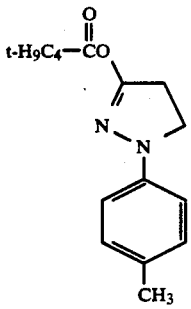
ETP-13-60
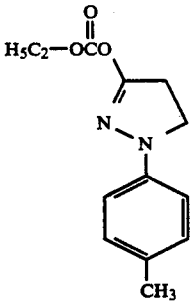
ETP-13-64
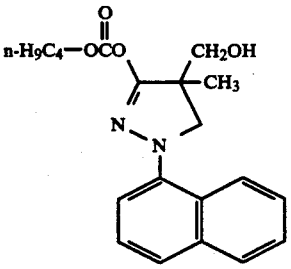
ETP-69-53
-continued
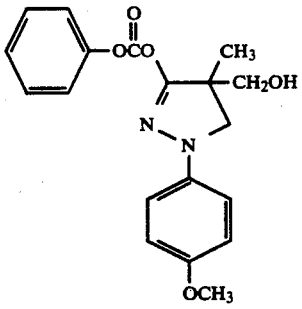
ETP-18-65
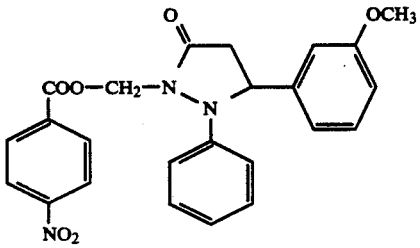
ETP-46-32
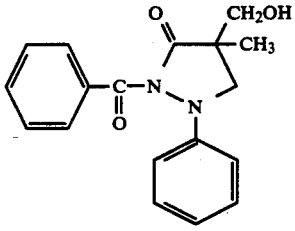
ETP-12-6
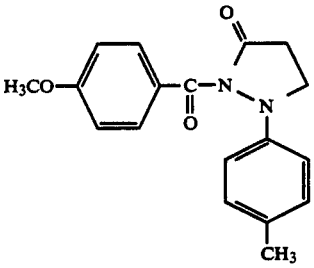
ETP-13-23
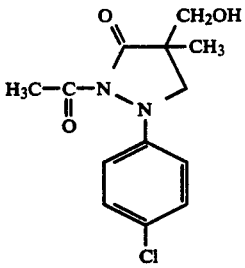
ETP-15-1
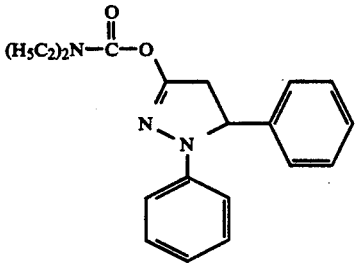
ETP-34-67

-continued
ETP-43-60
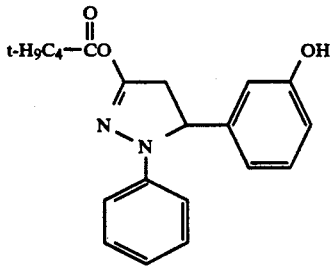
ETP-34-66
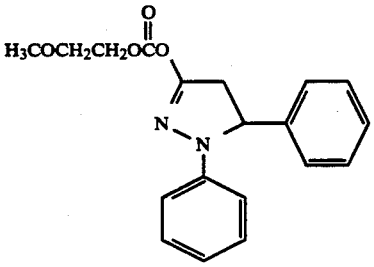
ETP-14-6
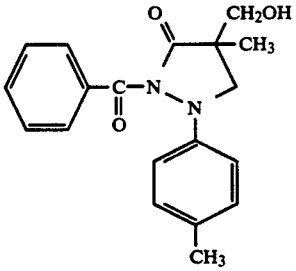
ETP-9-23
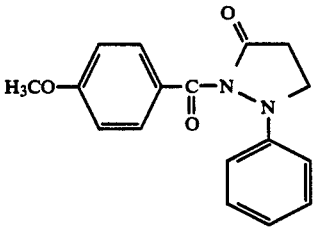
ETP-36-1
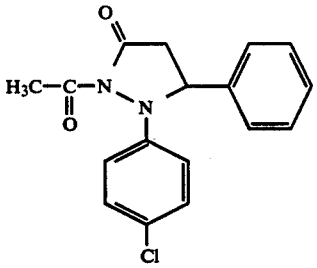
ETP-36-67
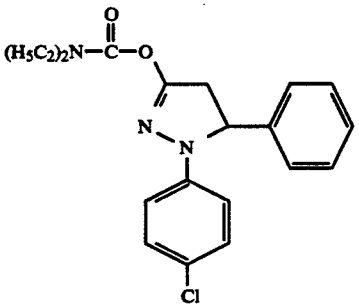
-continued
ETP-34-60
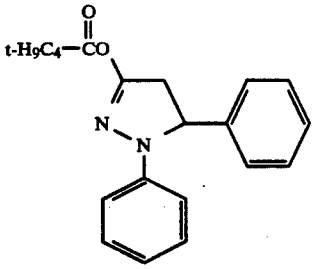
ETP-18-54
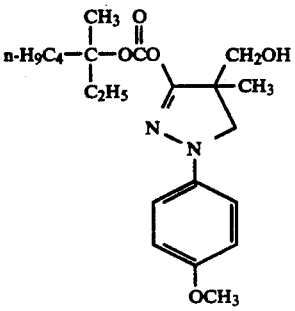
ETP-36-71
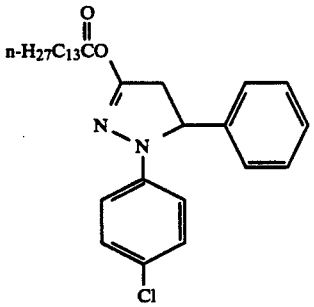
ETP-34-25
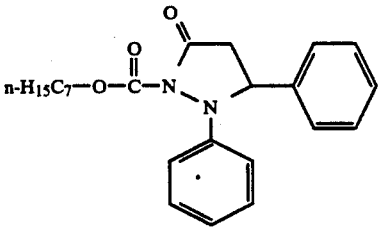
ETP-45-14
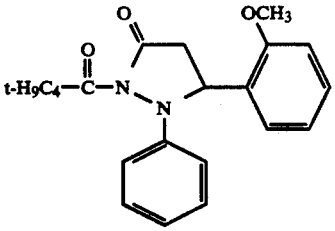
ETP-35-68
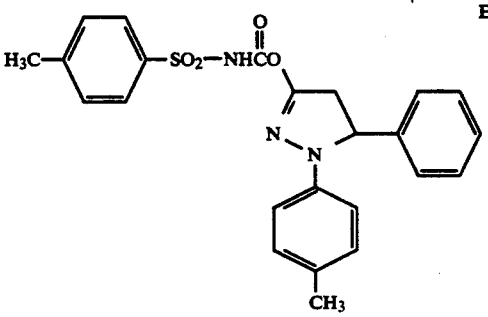

-continued
ETP-15-66
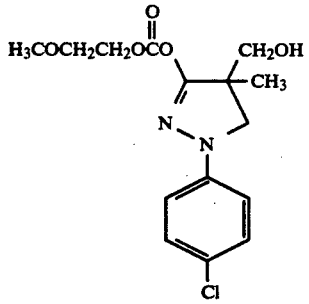
ETP-46-6
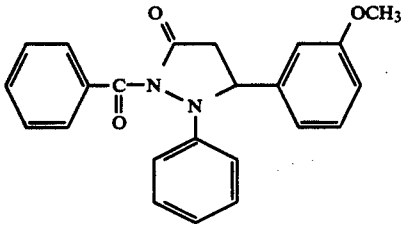
ETP-34-23
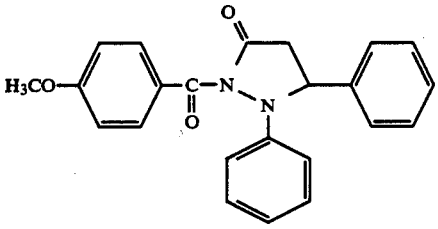
ETP-21-1
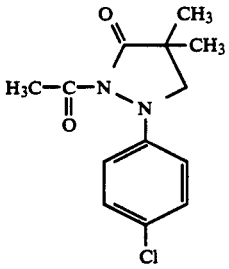
ETP-68-67
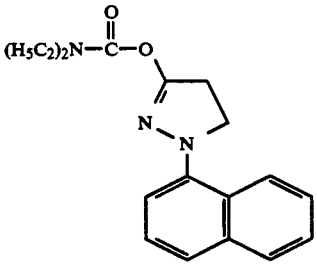
ETP-15-60
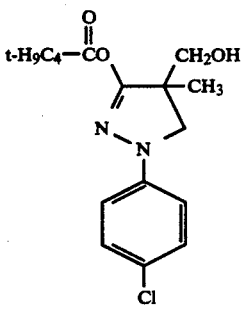
-continued
ETP-21-54
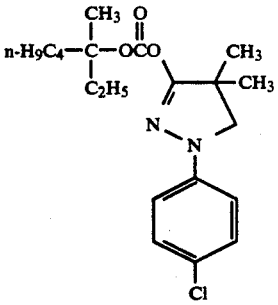
ETP-34-71
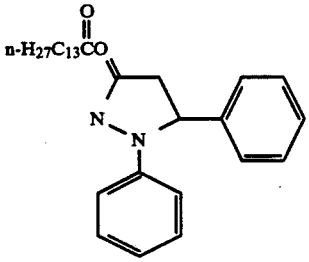
ETP-15-25
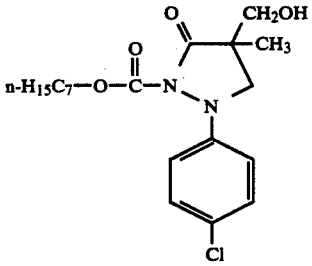
ETP-13-14
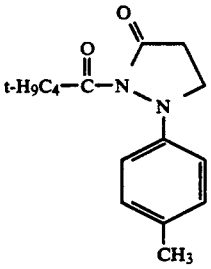
ETP-34-68
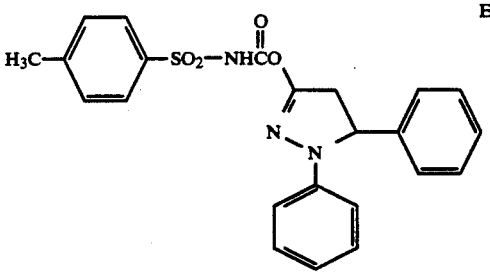
ETP-68-66
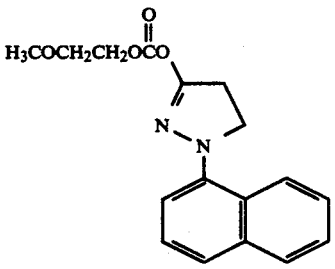

-continued
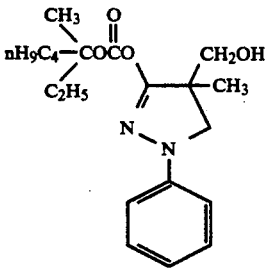
ETP-12-54
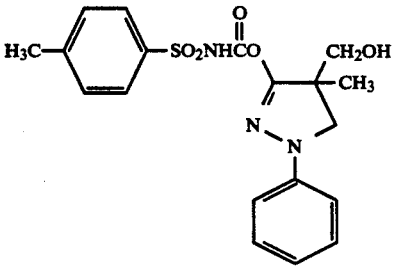
ETP-12-68
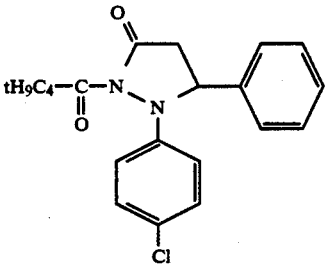
ETP-36-14
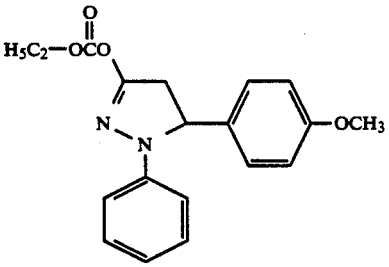
ETP-47-64
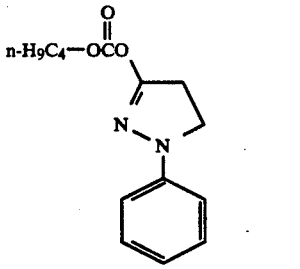
ETP-9-53
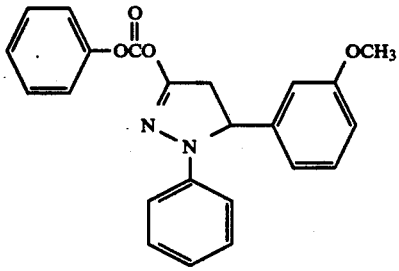
ETP-46-65
-continued
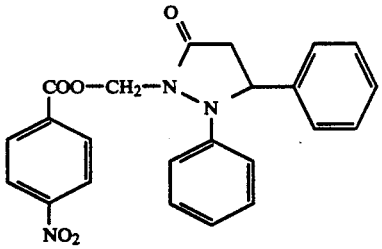
ETP-34-32
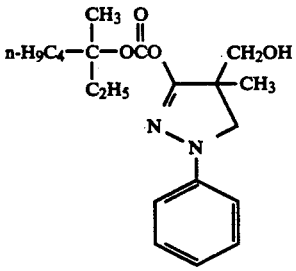
ETP-12-54
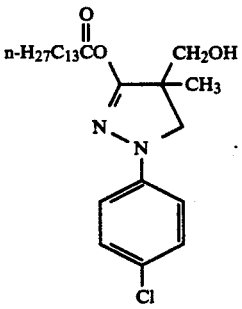
ETP-15-71
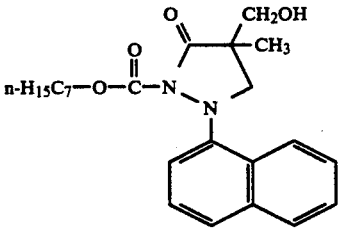
ETP-69-25
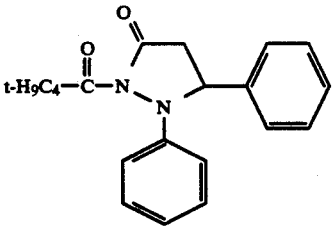
ETP-34-14
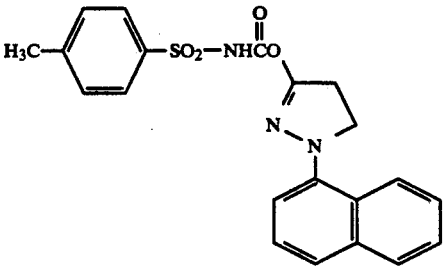
ETP-68-68

-continued

ETP-34-6

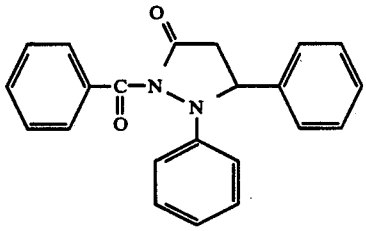

ETP-15-23

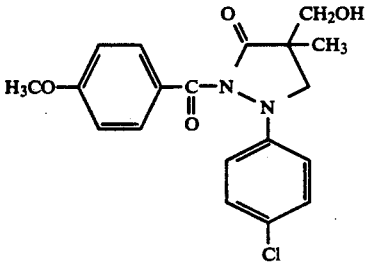

ETP-46-1

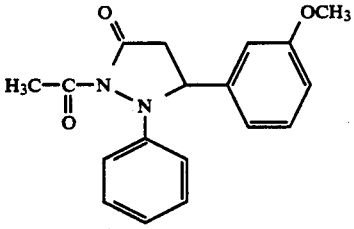

ETP-12-67

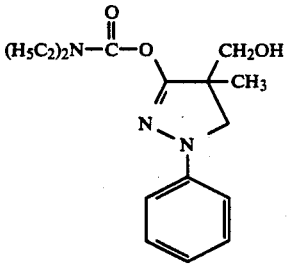

ETP-46-60

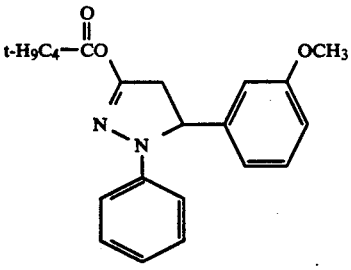

ETP-46-66

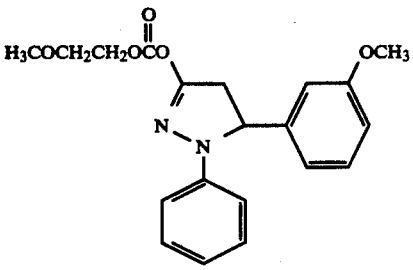

-continued

ETP-52-6

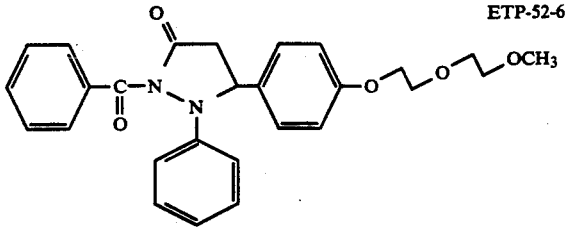

ETP-34-43

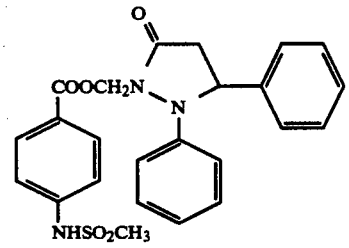

ETP-52-34

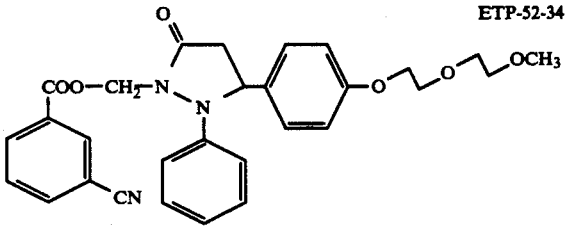

ETP-52-66

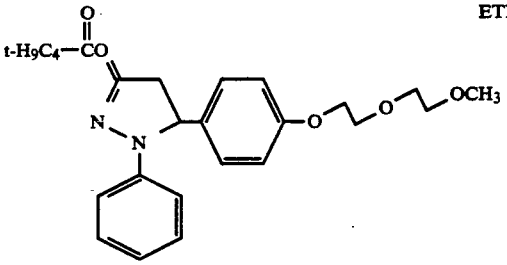

The electron-transferring agent precursor incorporated into the photographic material of the present invention may be decomposed to release an electron-transferring agent therefrom at a pertinent speed during storage of the material, while the electron-transferring agent originally incorporated into the photographic material is gradually oxidized to be lost during storage of the material, whereby the concentration of the electron-transferring agent in the material may be kept within a suitable range.

The range of the concentration of the electron-transferring agent precursor to be used for the purpose together with an electron-transferring agent is in mols from 0.01 time to 20 times the mols of the electron-transferring agent. Especially advantageously, the concentration range is, in mols, from 0.1 time to 5 times the mols of the electron-transferring agent.

In order that the electron-transferring agent precursor may be decomposed to release an electron-transferring agent in accordance with the speed of the decomposition of the originally existing electron-transferring agent to be lost whereby the concentration of the electron-transferring agent in the photographic material may always be kept constant, the decomposition speed of the electron-transferring agent precursor in the material is preferably within the range of from 0.01 to 100 times the decomposition speed of the originally existing electron-transferring agent, more preferably within the range of from 0.1 to 5 times thereof.

The electron-transferring agent to be released from the electron-transferring agent precursor for use in the present invention may be the same as or different from the electron-transferring agent originally incorporated in the photographic material. Preferably, the former is the same as the latter.

The compounds for use in the present invention may be produced by the methods described in the patent publications referred to hereinbefore as examples for the electron-transferring agent precursor.

The amount of the dye-forming compound to be incorporated into the photographic material of the present invention is within the range of from 0.05 to 5 mmol/$m^2$, preferably from 0.1 to 3 mmol/$m^2$, although this depends upon the absorbancy index of the dye formed therefrom. The dye-forming compound may be used either singly or in the form of a mixture of two or more different kinds of compounds. In order to obtain a black image or images with different hues, two or more kinds of dye-forming substances each releasing a mobile dye with a different hue are used as a mixture, for example, at least one cyan dye-forming substance, at least one magenta dye-forming substance and at least one yellow dye-forming substance are incorporated into the silver halide-containing layer or the adjacent layer in a photographic material, as described in JP-A-60-162251.

In accordance with the present invention, at least one of an electron-donating agent and a precursor thereof is incorporated into the photographic material, and the details of the compounds are described in European Patent 220,746A2 and Disclosure Bulletin 87-6199. Especially preferred electron-donating agents (substances) (as well as precursors thereof) for use in the present invention are compounds of the following general formula (C) or (D).

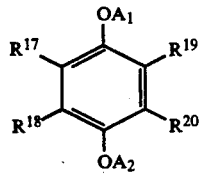

(C)

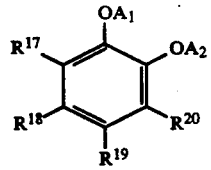

(D)

in which $A_1$ and $A_2$ each represent a hydrogen atom or a protective group for a phenollic hydroxyl group capable of being de-protected by a nucleophilic reagent.

As the nucleophilic reagent as herein referred to, there may be mentioned, for example, anionic reagents having $OH^-$, $R'O^-$ (where R' is an alkyl group or an aryl group), a hydroxamic acid anion or $SO_3^{2-}$, as well as non-covalent electron pair-containing compounds such as primary or secondary amines, hydrazines, hydroxylamines, alcohols and thiols.

Preferred examples of $A_1$ and $A_2$ include a hydrogen atom, an acyl group, an alkylsulfonyl group, an arylsulfonyl group, an alkoxycarbonyl group, an aryloxycarbonyl group, a dialkylphosphoryl group, a diarylphosphoryl group and the protected groups described in JP-A-59-197037 and JP-A-59-20105. If possible, $A_1$ and A2 may form a ring together with $R^1$, $R^2$, $R^3$ or $R^4$. $A_1$ and $A_2$ may be same or different.

In the formulae, $R^{17}$, $R^{18}$, $R^{19}$ and $R^{20}$ each represents a hydrogen atom, an alkyl group (which may optionally be substituted, for example, methyl, ethyl, n-buthyl, cyclohexyl, n-octyl, allyl, sec-octyl, tert-octyl, n-dodecyl, n-pentadecyl, n-hexadecyl, tert-octadecyl, 3-hexadecanoylaminophenylmethyl, 4-hexadecylsulfonylaminophenylmethyl, 2-ethoxycarbonylethyl, 3-carboxypropyl, N-ethylhexadecylsulfonylaminomethyl, N-methyldodecylsulfonylaminoethyl); an aryl group (which may optinally be substituted, for example, phenyl, 3-hexadecyloxyphenyl, 3-methoxyphenyl, 3-sulfophenyl, 3-chlorophenyl, 2-carboxyphenyl, 3-dodecanoylaminophenyl); an alkylthio group (which may optionally be substituted, for example, n-butylthio, methylthio, tert-octhylthio, n-dodecylthio, 2-hydroxyethylthio, n-hexadecylthio, 3-ethoxycarbonylpropiothio); an arylthio group (which may optionally be substituted, for example, phenylthio, 4-chlorophenylthio, 2-n-?loxy-5-t-butylphenylthio, 4-dodecyloxyphenylthio, 4-hexadecanoylaminophenylthio); a sulfonyl group (which is an optionally substituted aryl or alkylsulfonyl group, for example, methanesulfonyl, butanesulfonyl, p-toluenesulfonyl, 4-dodecyloxyphenylsulfonyl, 4-acetylaminophenylsulfonyl); a sulfo group; a halogen atom (e.g., fluorine, chloriene, bromine, iodine); a cyano group; a carbamoyl group (which may optionally be substituted, for example, methylcarbamoyl, diethylcarbamoyl, 3-(2,4-di-t-pentylphenyloxy)propylcarbamoyl, cyclohexylcarbamoyl, di-n-octylcarbamoyl); a sulfamoyl group (which may optinally be substituted, for example, diethylsulfamoyl, di-n-octylsulfamoyl, n-hexadecylsulfamoyl, 3-iso-hexadecanoylaminophenylsulfamoyl); an amido group (which may optionally be substituted, for example, acetamido, iso-butyroylamido, 4-tetradecyloxyphenylbenzamido, 3-hexadecanoylaminobenzamido); an imido group (which may optionally be substituted, for example, succinic acid imido, 3-laurylsuccinic acid imido, phthalimido); a carboxyl group; or a sulfonamido group (which may optionally be substituted, for example, methanesulfonamido, octanesulfonamido, hexadecanesulfonamido, benzenesulfonamido, toluenesulfonamido, 4-lauryloxybenzenesulfonamido). The total number of carbon atoms in $R^{17}$ to $R^{20}$ must be 8 or more. $R^{17}$ and $R^{18}$, and/or $R^{19}$ and $R^{20}$ in the formula (C); and $R^{17}$ and $R^{18}$, $R^{18}$ and $R^{19}$, and/or $R^{19}$ and $R^{20}$ in the formula (C) may be bonded together to form a saturated or unsaturated ring.

Among the electron-donating substances of the above-mentioned formulae (C) and (D), those where at least two of $R^{17}$ to $R^{20}$ are other substituents than hydrogen are preferred. In particular, those where at least one of $R^{17}$ and $R^{18}$ and at least one of $R^{19}$ and $R^{20}$ are other substituents than hydrogen are especially preferred.

Two or more kinds of different electron-donating substances may be used together, or these may be used together with precursors thereof. The electron-donating substances may be same as the reducing substances for use in the present invention. Specific examples of the electron-donating substances for use in the present invention are mentioned below, which, however are not limitative.

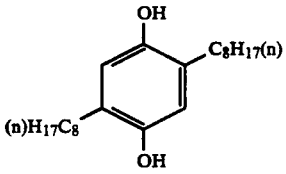
(ED-1)
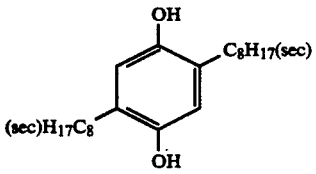
(ED-2)
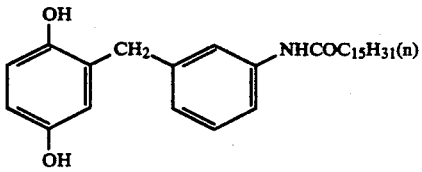
(ED-3)
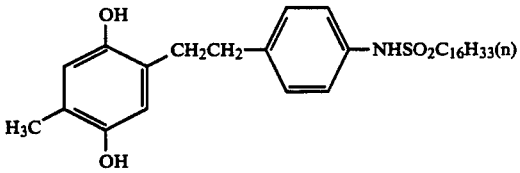
(ED-4)
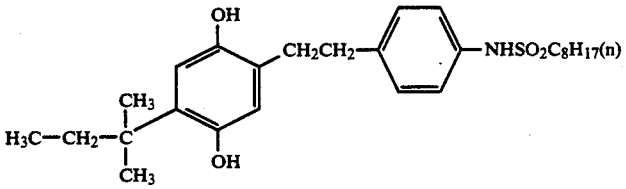
(ED-5)
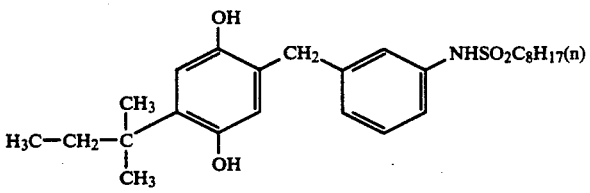
(ED-6)
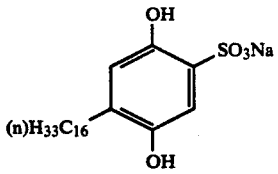
(ED-7)
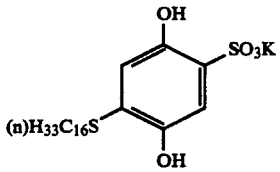
(ED-8)
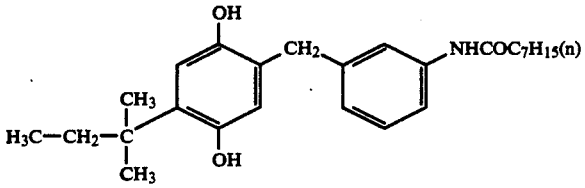
(ED-9)

-continued

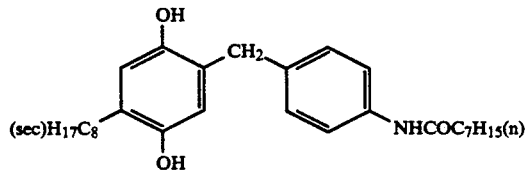

ED-10)

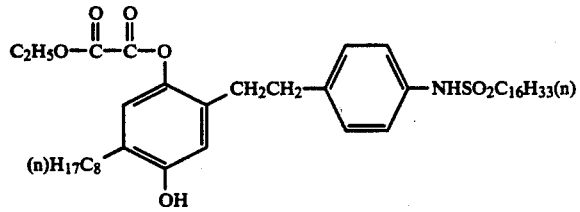

(ED-11)

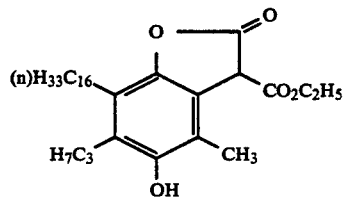

(ED-12)

The amount of the electron-donating substance (or a precursor thereof) may be in a broad range but is preferably within a range of from 0.01 mol to 50 mols, especially from 0.1 mol to 5 mols, per mol of the positive dye-forming substance. This is from 0.001 mol to 5 mols, preferably from 0.01 mol to 1.5 mols, per mol of the silver halide in the photographic material.

In accordance with the present invention, the above-mentioned electron-transferring agent and electron-transferring agent precursor are combined with a binder and a silver halide emulsion together with the above-mentioned reducible dye-forming compound and electron-donating agent to form a light-sensitive layer of one unit. The reducible dye-forming compound may be added to the same layer as that containing a silver halide emulsion, but this may be added to the adjacent layer separately from the silver halide emulsion. In the latter case, it is preferred that the reducible dye-forming compound-containing layer is positioned below the silver halide emulsion-containing layer in view of the sensitivity of the photographic material. In this case, the electron-transferring agent and electron-transferring agent precursor and the electron-donating substance may be added to either the silver halide emulsion-containing layer or the reducible dye-forming compound-containing layer, but it is preferred that at least the electron-transferring agent and the electron-transferring agent precursor are present in the silver halide emulsion layer. In the present invention, at least one of light-sensitive layer units of the kind described above is used in preparation of the photographic material. In general, three groups of light-sensitive layers each having a different color-sensitivity are provided in the photographic material for reproduction of full color. For instance, there is a combination of three groups of a blue-sensitive layer, a green-sensitive layer and a red-sensitive layer and a combination of three groups of a green-sensitive layer, a red-sensitive layer and an infrared-sensitive layer. The respective color-sensitive layers may be arranged in various orders which are known in the field of conventional color photographic materials. The respective color-sensitive layers may optionally comprise two or more layers, if desired.

In accordance with the present invention, it is preferred to provide a substantially non-light-sensitive interlayer which contains a non-diffusible reducible substance which may be cross-oxidized with the oxidation product of an electron-transferring agent, between the light-sensitive layers each having a different color-sensitivity, so as to prevent any possible coloring defects which are called color transferring or color mixing. When the photographic material has three groups of light-sensitive layer units each having a different color-sensitivity, the interlayer is preferably provided between the respective light-sensitive layer units. When the photographic material has plural interlayers, the aforesaid reducible substance to be added to the respective interlayers may be the same or different.

Next, the reducible dye-forming compounds for use in the present invention will be explained in detail.

The reducible dye-forming compounds for use in the present invention are preferably compounds represented by the following general formula (L):

$$\text{PWR-(Time)}_t\text{-Dye} \qquad \text{(L)}$$

in which PWR represents a group capable of releasing -(Time)$_t$-Dye by reduction; Time represents a group which may release Dye by the subsequent reaction, after having been released from PWR in the form of -(Time)$_t$-Dye;

t represents an integer of 0 or 1; and

Dye represents a dye or a precursor thereof.

First, PWR is explained in detail.

PWR may be a group which corresponds to a moiety containing an electron-accepting center and an intramolecular nucleophilic reaction center in a compound capable of releasing a photographic reagent by an intramolecular nucleophilic substitution reaction after reduction, as illustrated in U.S. Pat. Nos. 4,139,389, 4,139,379 and 4,564,577 and JP-A-59-185333 and JP-A-57-84453, or a group which corresponds to a moiety containing an electron-accepting quinoid center and a carbon atom to bond the center to a photographic reagent in a compound capable of releasing the photographic reagent by an intramolecular electron transfer reaction after reduction, as illustrated in U.S. Pat. No. 4,232,107, JP-A-59-101649, *Research Disclosure* (1984), IV, 24025 and JP-A-61-99257. In addition, this may also be a group which corresponds to a moiety containing an electron-attracting group-substituted aryl group and an atom (sulfur, carbon or nitrogen atom) to bond the group to a photographic reagent in a compound capable of releasing the photographic reagent by cleavage of the single bond after reduction, as illustrated in JP-A-56-142530, U.S. Pat. Nos. 4,343,893 and 4,619,884. Further, this may also be a group which corresponds to a moiety containing a nitro group and a carbon atom to bond the group to a photographic reagent in a nitro compound capable of releasing the photographic reagent after acceptance of an electron, as illustrated in U.S. Pat. No. 4,450,223, or a group which corresponds to a moiety containing a dieminal-dinitro group and a carbon atom to bond the group to a photographic reagent in a dinitro compound capable of beta-releasing the photographic reagent after acceptance of an electron, as described in U.S. Pat. No. 4,609,610.

Further, there are mentioned the compounds having $SO_2$—X″ (where X″ represents anyone of oxygen, sulfur and nitrogen atoms) and an electron-attracting group in one molecule as described in JP-A-62-106885; the compounds having a PO—X″ bond (where X″ has the same meaning as mentioned above) and an electron-attracting group in one molecule as described in JP-A-62-106895; and the compounds having a C—X′ bond (where X′ has the same meaning as X″ or represents —$SO_2$—) and an electron-attracting group in one molecule as described in JP-A-62-106887.

Among the compounds of the formula (L), those represented by the following formula (L-II) are preferred so as to more sufficiently attain the object of the present invention.

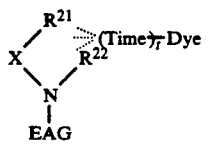

(L-II)

in which $(Time)_r$-Dye is bonded to at least one of $R^{21}$, $R^{22}$ and EAG.

The moiety which corresponds to PWR in the formula (L-II) will be explained hereunder.

X represents an oxygen atom (—O—), a sulfur atom (—S—) or a nitrogen-containing group (—N($R^{23}$)—).

$R^{21}$, $R^{22}$ and $R^{23}$ each represents a substituent except a hydrogen atom or $R^{21}$, $R^{22}$ and $R^{23}$ represent a chemical bond.

Substituents except a hydrogen atom for $R^{21}$, $R^{22}$ and $R^{23}$ include an alkyl or aralkyl group (which may optionally be substituted, for example, methyl, trifluoromethyl, benzyl, chloromethyl, dimethylaminomethyl, ethoxycarbonylmethyl, aminomethyl, acetylaminomethyl, ethyl, 2-(4-dodecanoylaminophenyl)ethyl, carboxyethyl, allyl, 3,3,3-trichloropropyl, n-propyl, isopropyl, n-butyl, iso-butyl, sec-butyl, t-butyl, n-pentyl, sec-pentyl, t-pentyl, cyclopentyl, n-hexyl, sec-hexyl, t-hexyl, cyclohexyl, n-octyl, sec-octyl, t-octyl, n-decyl, n-undecyl, n-dodecyl, n-tetradecyl, n-pentadecyl, n-hexadecyl, sec-hexadecyl, t-hexadecyl, n-octadecyl, t-octadecyl); an alkenyl group (which may optionally be substituted, for example, vinyl, 2-chlorovinyl, 1-methylvinyl, 2-cyanovinyl, cyclohexen-1-yl); an alkynyl group (which may optionally be substituted, for example, ethynyl, 1-propynyl, 2-ethoxycarbonylethynyl); an aryl group (which may optionally be substituted, for example, phenyl, naphthyl, 3-hydroxyphenyl, 3-chlorophenyl, 4-acetylaminophenyl, 4-hexadecanesulfonylaminophenyl, 2-methanesulfonyl-4-nitrophenyl, 3-nitrophenyl, 4-methoxyphenyl, 4-acetylaminophenyl, 4-methanesulfonylphenyl, 2,4-dimethylphenyl, 4-tetradecyloxyphenyl); a heterocyclic group (which may optionally be substituted, for example, 1-imidazolyl, 2-furyl, 2-pyridyl, 5-nitro-2-pyridyl, 3-pyridyl, 3,5 -dicyano-2-pyridyl, 5-tetrazolyl, 5-phenyl-1-tetrazolyl, 2-benzothiazolyl, 2-benzimidazolyl, 2-benzoxazolyl, 2-oxazolin-2-yl, morpholino); an acyl group (which may optionally be substituted, for example, acetyl, propionyl, butyroyl, iso-butyroyl, 2,2-dimethylpropionyl, benzoyl, 3,4-dichlorobenzoyl, 3-acetylamino-4-methoxybenzoyl, 4-methylbenzoyl, 4-methoxy-3-sulfobenzoyl); a sulfonyl group (which may optionally be substituted, for example, methanesulfonyl, ethanesulfonyl, chloromethanesulfonyl, propanesulfonyl, butanesulfonyl, n-octanesulfonyl, n-dodecanesulfonyl, n-hexadecanesulfonyl, benzenesulfonyl, 4-toluenesulfonyl, 4-n-dodecyloxy benzenesulfonyl); a carbamoyl group (which may optionally be substituted, for example, carbamoyl, methylcarbamoyl, dimethyl carbamoyl, bis-(2-methoxyethyl)carbamoyl, diethylcarbamoyl, cyclohexylcarbamoyl, di-n-octylcarbamoyl, 3-dodecyloxypropylcarbamoyl, hexadecylcarbamoyl, 3-(2,4-di-t-pentylphenoxy)propylcarbamoyl, 3-octanesulfonylaminophenylcarbamoyl, di-n-octadecylcarbamoyl); a sulfamoyl group (which may optionally be substituted, for example, sulfamoyl, methylsulfamoyl, dimethylsulfamoyl, diethylsulfamoyl, bis(2-methoxyethyl)sulfamoyl, di-n-butylsulfamoyl, methyl-n-octylsulfamoyl, n-hexadecylmethylsulfamoyl, 3-ethoxypropylmethylsulfamoyl, N-phenyl-N-methylsulfamoyl, 4-decyloxyphenylsulfamoyl, methyloctadecylsulfamoyl).

$R^{21}$ and $R^{23}$ each are preferably a substituted or unsubstituted alkyl, alkenyl, alkynyl, aryl, heterocyclic, acyl or sulfonyl group. The number of the carbon atoms in $R^{21}$ and $R^{23}$ is preferably from 1 to 40.

$R^{22}$ is preferably a substituted or unsubstituted acyl or sulfonyl group. The number of the carbon atoms in the group is preferably from 1 to 40.

$R^{21}$, $R^{22}$, $R^{23}$ and EAG may be bonded to each other to form a 5-membered to 8-membered ring.

EAG will be explained below in the context of the formula (L-III).

Among the compounds of the formula (L-II), those represented by the following formula (L-III) are more preferred in order to more satisfactorily attain the object of the present invention.

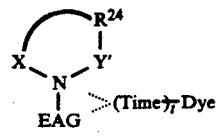

(L-III)

in which $(Time)_r$-Dye is bonded to at least one of $R^{24}$ and EAG.

The moiety which corresponds to PWR in the formula (L-III) will be mentioned below.

Y' is a divalent linking group and is preferably —CO—, or —$SO_2$—. X has the same meaning as defined above for the formula (L-II). $R^{24}$ forms a 5-membered to 8-membered (inclusive of nitrogen, Y' and X in the formula) mono-cyclic or condensed-cyclic hetero-ring.

Preferred examples of the hetero-ring moiety in the formula are mentioned below.

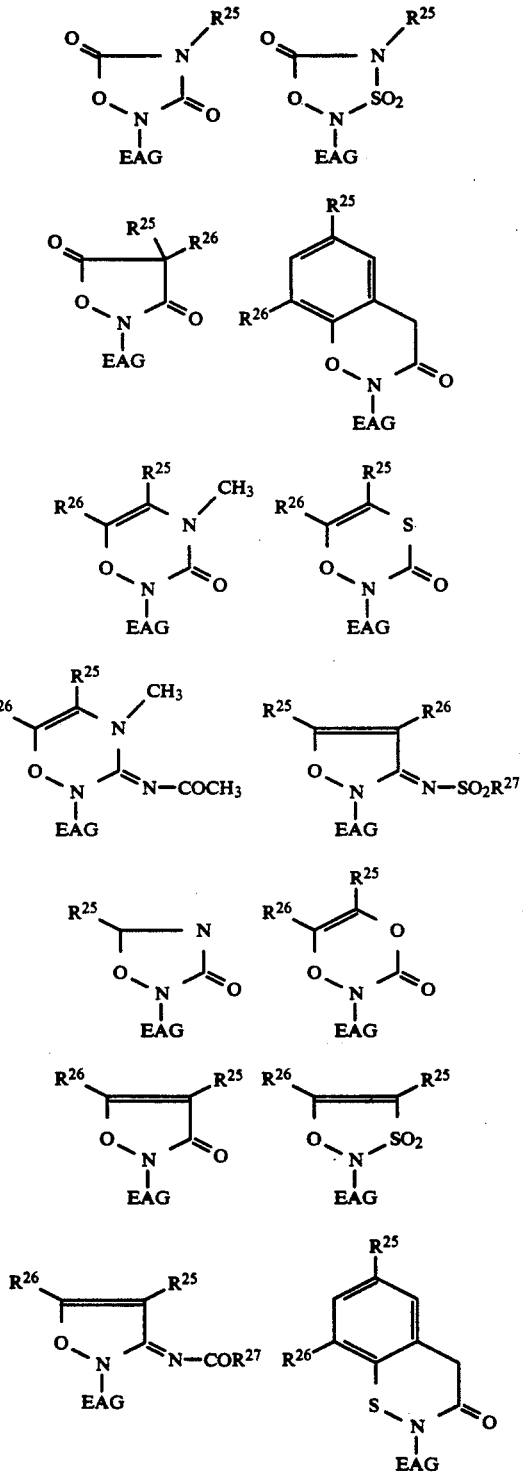

-continued

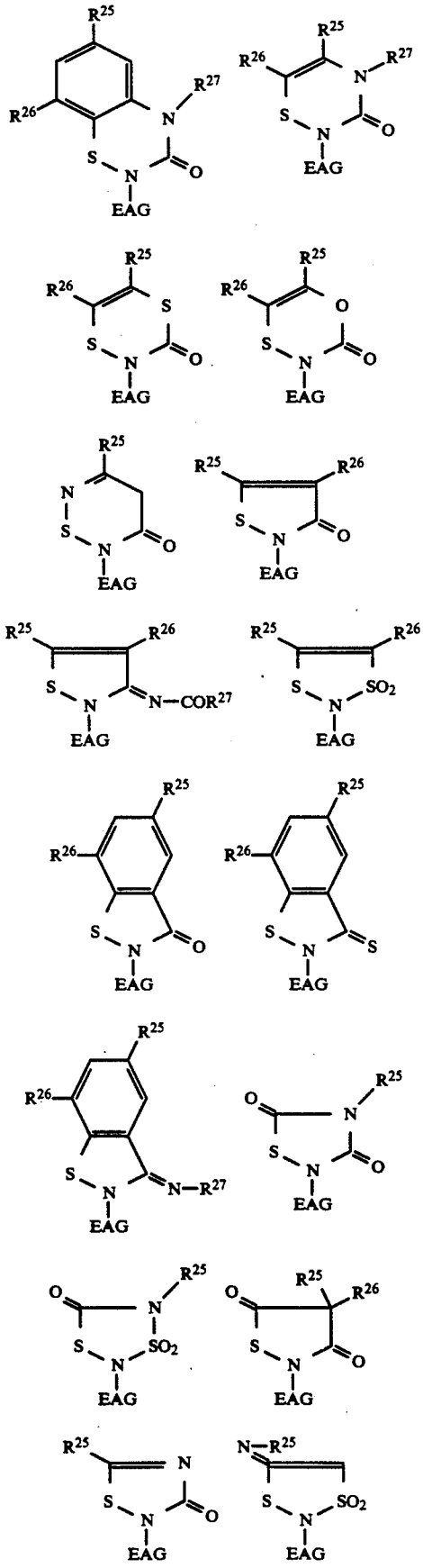

-continued

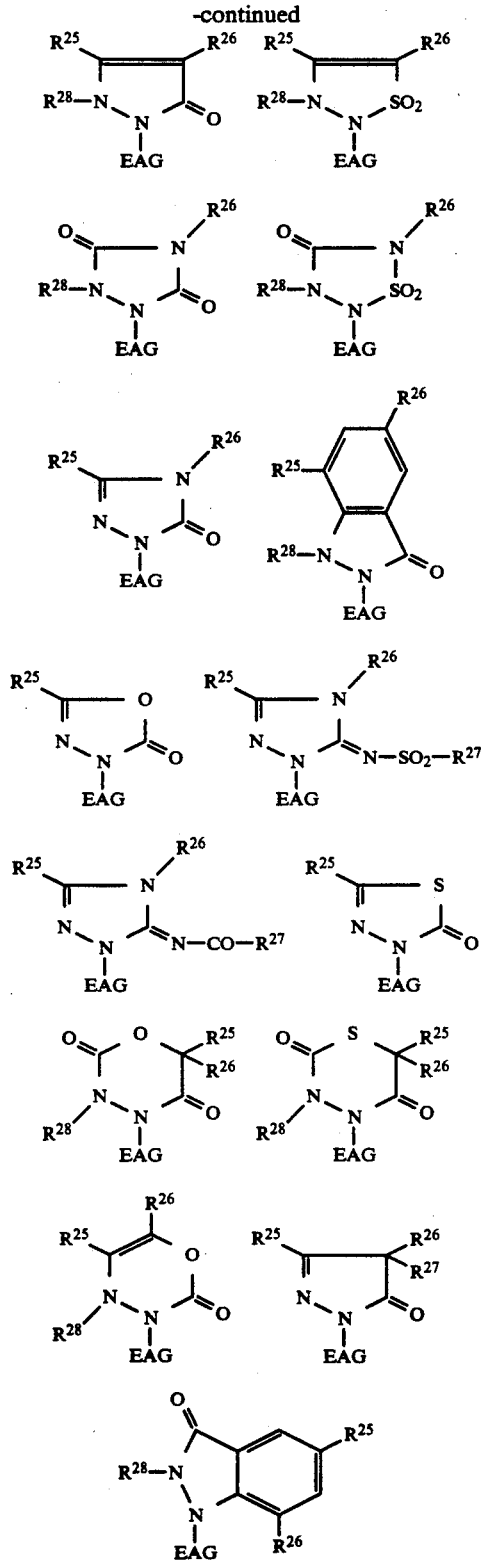

In these formulae, $R^{25}$, $R^{26}$ and $R^{27}$ each are preferably a hydrogen atom, an alkyl group, an aryl group or a heterocyclic group. $R^{28}$ represents an alkyl group, an aryl group, an acyl group or a sulfonyl group. $(Time)_r$-Dye may be bonded to $R^{25}$, $R^{26}$ or $R^{27}$.

EAG has an aromatic group capable of accepting an electron from a reducible substance and is bonded to a nitrogen atom. EAG is preferably a group represented by the following formula (A):

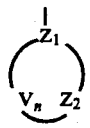

(A)

In the formula (A), $Z_1$ and $Z_2$, which are the same or different, represent

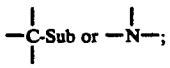

$V_n$ represents an atomic group necessary to form a 3- to 8-membered aromatic group together with $Z_1$ and $Z_2$; and n represents an integer of from 3 to 8.

$V_3$ means $—Z_3—$; $V_4$ means $—Z_3—Z_4—$; $V_5$ means $—Z_3—Z_4—Z_5—$; $V_6$ means $—Z_3—Z_4—Z_5—Z_6—$; $V_7$ means $—Z_3—Z_4—Z_5—Z_6—Z_7—$; $V_8$ means $—Z_3—Z_4—Z_5—Z_6—Z_7—Z—$. $Z_3$ to $Z_8$ each represents

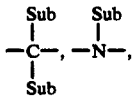

—O—, —S— or $—SO_2—$; Sub independently represents a chemical bond ($\pi$-bond), a hydrogen atom or a substituent mentioned below. Sub's may be the same or different and they may be bonded to each other to form a 3-membered to 8-membered, saturated or unsaturated carbon-ring or hetero-ring.

In the formula (A), Sub's are so selected that the total of the Hammett's substituent constants (sigma para) of all the substituents may be +0.50 or more, preferably +0.70 or more, most preferably +0.85 or more.

EAG will be explained in more detail hereunder.

EAG represents a group capable of accepting an electron from a reducible substance and is bonded to a nitrogen atom. EAG is preferably an aryl group or heterocyclic group substituted by at least one electron-attracting group. The substituents to be bonded to the aryl group or heterocyclic group for EAG may be utilized for adjusting the total properties of the compounds. More precisely, the substituents may be utilized for adjusting the total properties of the compounds, for example, the easy acceptability of electrons, as well as the water-solubility, the oil-solubility, the diffusibility, the sublimability, the melting point, the dispersibility in binders such as gelatin, the reactivity with nucleophilic groups and the reactivity with electrophilic groups.

Specific examples of EAG are set forth below, but do not limited the invention. As examples of aryl groups substituted by at least one or more electron attracting groups, there are a 4-nitrophenyl group, 2-nitrophenyl group, 2-nitro-4-N-methyl-N-n-butylsulfamoylphenyl group, 2-nitro-4-N-methyl-N-n-octylsulfamoylphenyl group, 2-nitro-4-N-methyl-N-n-dodecylsulfamoylphenyl group, 2-nitro-4-N-methyl-N-n-hexadecylsulfamoylphenyl group, 2-nitro-4-N-methyl-N-n-octadecylsulfamoylphenyl group, 2-nitro-4-N-methyl-N-(3-carboxypropyl)sulfamoylphenyl group, 2-nitro-4-N-ethyl-N-(2-sulfoethyl)sulfamoylphenyl group, 2-nitro-4-N-n-hexadecyl-N-(3-sulfopropyl)sulfamoylphenyl group, 2-nitro-4-N-(2-cyanoethyl)-N-((2-hydroxyethoxy)ethyl)sulfamoylphenyl group, 2-nitro-4-diethylsulfamoylphenyl group, 2-nitro-4-di-n-butyl-sulfamoylphenyl group, 2-nitro-4-di-n-octylsulfamoylphenyl group, 2-nitro-4-di-n-octadecylsulfamoylphenyl group, 2-nitro-4-methylsulfamoylphenyl group, 2-nitro-4-n-hexadecylsulfamoylphenyl group, 2-nitro-4-N-methyl-N-(4-dodecylsulfonylphenyl)sulfamoylphenyl group, 2-nitro-4-(3-methylsulfamoylphenyl)sulfamoylphenyl group, 4-nitro-2-N-methyl-N-n-butylsulfamoylphenyl group, 4-nitro-2-N-methyl-N-n-octylsulfamoylphenyl group, 4-nitro-2-N-methyl-N-n-dodecylsulfamoylphenyl group, 4-nitro-2-N-methyl-N-n-hexadecylsulfamoylphenyl group, 4-nitro-2-N-methyl-N-n-octadecylsulfamoylphenyl group, 4-nitro-2-N-methyl-N-(3-carboxypropyl)sulfamoylphenyl group, 4-nitro-2-N-ethyl-N-(2-sulfoethyl)sulfamoylphenyl group, 4-nitro-2-N-n-hexadecyl-N-(3-sulfopropyl)sulfamoylphenyl group, 4-nitro-2-N-(2-cyanoethyl)-N-((2-hydroxyethoxyethyl)sulfamoylphenyl group, 4-nitro-2-diethylsulfamoylphenyl group, 4-nitro-2-di-n-butylsulfamoylphenyl group, 4-nitro-2-di-n-octylsulfamoylphenyl group, 4-nitro-2-di-n-octadecylsulfamoylphenyl group, 4-nitro-2-methylsulfamoylphenyl group, 4-nitro-2-n-hexadecylsulfamoylphenyl group, 4-nitro-2-N-methyl-n-(4-dodecylsulfonylphenyl)sulfamoylphenyl group, 4-nitro-2-(3-methylsulfamoylphenyl)sulfamoylphenyl group, 4-nitro-2-chlorophenyl group, 2-nitro-4-chlorophenyl group, 2-nitro-4-N-methyl-N-n-butylcarbamoylphenyl group, 2-nitro-4-N-methyl-N-n-octylcarbamoylphenyl group, 2-nitro-4-N-methyl-N-n-dodecylcarbamoylphenyl group, 2-nitro-4-N-methyl-N-n-hexadecylcarbamoylphenyl group, 2-nitro-4-N-methyl-N-n-octadecylcarbamoylphenyl group, 2-nitro-4-N-methyl-N-(3-carboxypropyl)carbamoylphenyl group, 2-nitro-4-N-methyl-N-(2-sulfoethyl)carbamoylphenyl group, 2-nitro-4-N-n-hexadecyl-N-(3-sulfopropyl)carbamoylphenyl group, 2-nitro-4-N-(2-cyanoethyl)-N-((2-hydroxyethoxy)ethyl)carbamoylphenyl group, 2-nitro-4-diethylcarbamoylphenyl group, 2-nitro-4-di-n-butylcarbamoylphenyl group, 2-nitro-4-di-n-octylcarbamoylphenyl group, 2-nitro-4-di-n-octadecylcarbamoylphenyl group, 2-nitro-4-methylcarbamoylphenyl group, 2-nitro-4-n-hexadecylcarbamoylphenyl group, 2-nitro-4-N-methyl-N-(4-dodecylsulfonylphenyl)carbamoylphenyl group, 2-nitro-4-(3-methylsulfamoylphenyl)carbamoylphenyl group, 4-nitro-2-N-methyl-N-n-butylcarbamoylphenyl group, 4-nitro-2-N-methyl-N-n-octylcarbamoylphenyl group, 4-nitro-2-N-methyl-N-n-dodecylcarbamoylphenyl group, 4-nitro-2-N-methyl-N-n-hexadecylcarbamoylphenyl group, 4-nitro-2-N-methyl-N-n-octadecylcarbamoylphenyl group, 4-nitro-2-N-methyl-N-(3-carboxypropyl)carbamoylphenyl group, 4-nitro-2-N-ethyl-N-(2-sulfoethyl)carbamoylphenyl group, 4-nitro-2-N-n-hexadecyl-N-(3-sulfopropyl)carbamoylphenyl group, 4-nitro-2-N-(2-cyanoethyl)-N-((2-hydroxyethoxy)ethyl)carbamoylphenyl group, 4-nitro-2-diethylcarbamoylphenyl group, 4-nitro-2-di-n-butylcarbamoylphenyl group, 4-nitro-2-di-n-octylcarbamoylphenyl group, 4-nitro-2-di-n-octadecylcarbamoylphenyl group, 4-nitro-2-methylcarbamoylphenyl group, 4-nitro-2-n-hexadecylcarbamoylphenyl group, 4-nitro-2-N-methyl-N-(4-dodecylsulfonylphenyl)carbamoylphenyl group, 4-nitro-2-(3-methylsulfamoylphenyl)carbamoylphenyl group, 2,4-dimethanesulfonylphenyl group, 2-methanesulfonyl-4-benzenesulfonylphenyl group, 2-n-octanesulfonyl-4-methanesulfonylphenyl group, 2-n-tetradecanesulfonyl-4-methanesulfonylphenyl group, 2-n-hexadecanesulfonyl-4-methanesulfonylphenyl group, 2,4-di-n-dodecanesulfonylphenyl group, 2,4-didodecanesulfonyl-5-trifuloromethylphenyl group, 2-n-dedanesulfonyl-4-cyanotrifluoromethylphenyl group, 2-cyano-4-methanesulfonylphenyl group, 2,4,6-tricyanophenyl group, 2,4-dicyanophenyl group, 2-nitro-4-methanesulfonylphenyl group, 2-nitro-4-n-dodecanesulfonylphenyl group, 2-nitro-4-(2-sulfoethylsulfonyl)phenyl group, 2-nitro-4-carboxymethylsulfonylphenyl group, 2-nitro-4-carboxyphenyl group, 2-nitro-4-ethoxycarbonyl-5-n-butoxyphenyl group, 2-nitro-4ethoxycarbonyl-5-n-hexadecyloxyphenyl group, 2-nitro-4-diethylcarbomyl-5-n-hexadecyloxyphenyl group, 2-nitro-4-cyano-5-n-dodecylphenyl group, 2,4-dinitrophenyl group, 2-nitro-4-n-decylthiophenyl group, 3,5-dinitrophenyl group, 2-nitro-3,5-dimethyl-4-n-hexadecanesulfonyl group, 4-methanesulfonyl-2-benzenesulfonylphenyl group, 4-n-octanesulfonyl-2-methanesulfonylphenyl group, 4-n-tetradecanesulfonyl-2-methanesulfonylphenyl group, 4-n-hexadecanesulfonyl-2-methanesulfonylphenyl group, 2,5-didodecanesulfonyl-4-trifluoromethylphenyl group, 4-n-decanesulfonyl-2-cyano-5-trifuloromethylphenyl group, 4-cyano-2-methanesulfonylphenyl group, 4-nitro-2-methanesulfonylphenyl group, 4-nitro-2-n-dodecanesulfonylphenyl group, 4-nitro-2-(2-sulfoethylsulfonyl)phenyl group, 4-nitro-2-carboxymethylsulfonylphenyl group, 4-nitro-2-carboxyphenyl group, 4-nitro-2-ethoxycarbonyl-5-n-butoxyphenyl group, 4-nitro-2-ethoxycarbonyl-5-n-hexadecyloxyphenyl group, 4-nitro-2-diethylcarbamoyl-5-n-hexadecyloxyphenyl group, 4-nitro-2-cyano-5-n-dodecylphenyl group, 4-nitro-2-n-decylthiophenyl group, 4-nitro-3,5-dimethyl-2-n-hexadecanesulfonyl group, 4-nitronaphthyl group, 2,4-dinitronaphthyl group, 4-nitro-2-n-octadecylcarbamoylnaphthyl group, 4-nitro-2-dioctylcarbamoyl-5-(3-sulfobenzenesulfonylamino)naphthyl group, 2,3,4,5,6-pentafluorophenyl group, 2-nitro-4-benzoylphenyl group, 2,4-diacetylphenyl group, 2-nitro-4-trifluoromethylphenyl group, 4-nitro-2-trifluoromethylphenyl group, 4-nitro-3-trifluoromethylphenyl group, 2,4,5-tricyanophenyl group, 3,4-dicyanophenyl group, 2-chloro-4,5-dicyanophenyl group, 2-bromo-4,5-dicyanophenyl group, 4-methanesulfonyl group, 4-n-hexadecanesulfonylphenyl group, 2-decanesulfonyl-5-trifluoromethylphenyl group, 2-nitro-5-methylphenyl group, 2-nitro-5-n-octadecyloxyphenyl group, 2-nitro-4-N-(vinylsulfonylethyl)-N-methylsulfamolyphenyl group, 2-methyl-6-nitrobenzoxazol-5-yl group.

As examples of heterocyclic groups, there are a 2-pyridyl group, 3-pyridyl group, 4-pyridyl group, 5-nitro-2-pyridyl group, 5-nitro-N-hexadecylcarbamoyl-2-pyridyl group, 3,5-dicyano-2-pyridyl group, 5-dodecanesulfonyl-2-pyridyl group, 5-cyano-2-pyrazyl group, 4-nitrothiophen-2-yl group, 5-nitro-1,2-dimethylimidazol-4-yl group, 3,5-diacetyl-2-pyridyl group, 1-dodecyl-5-carbamoylpyridinium-2-yl group, 5-nitro-2-furyl group, and 5-nitrobenzothiazol-2-yl group.

Time represents a group which may release Dye via the subsequent reaction triggered by the cleavage of the nitrogen-oxygen, nitrogen-nitrogen or nitrogen-sulfur bond.

The groups for Time are known, and for example, there may be mentioned the groups described in JP-A-61-147244, pages 5 to 6, JP-A-61-236549, pages 8 to 14 and Japanese Patent Application No. 61-88625, pages 36 to 44.

Examples of the dye for Dye include azo dyes, azomethine dyes, anthraquinone dyes, naphthoquinone dyes, styryl dyes, nitro dyes, quinoline dyes, carbonyl dyes, and phthalocyanine dyes. These dyes may be used also in a temporarily short-waved form which may be recolored in development.

Concretely, the dyes as illustrated in European Patent 76,492A2 and JP-A-59-165054 can be used for Dye in the present invention.

Specific examples of the reducible dye-forming compounds for use in the present invention are set forth below, which, however are not whatsoever limitative. In addition to them, the dye-forming compounds described in European Patent Application 220,746A2 and Disclosure Bulletin 87-6199 may also be used.

(1)

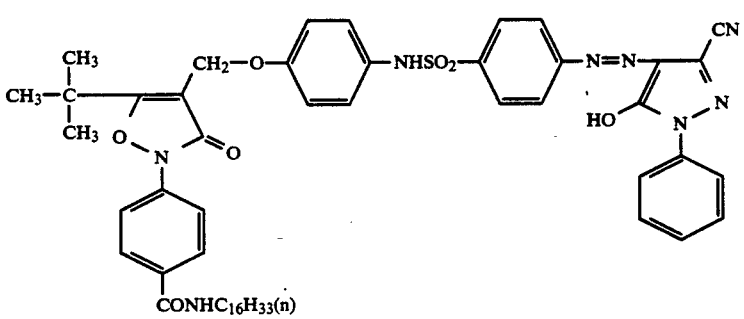

(2)

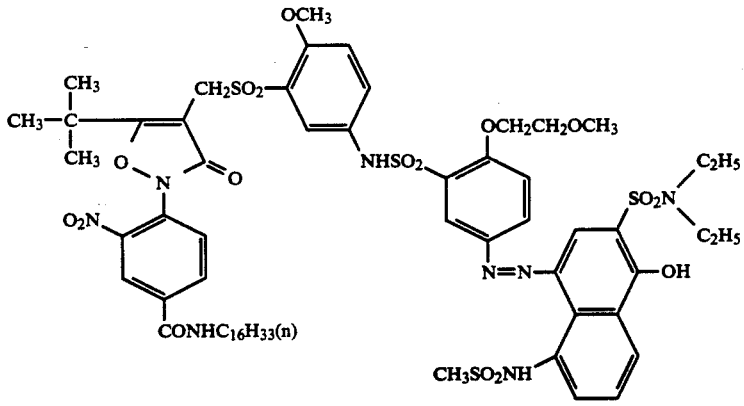

(3)

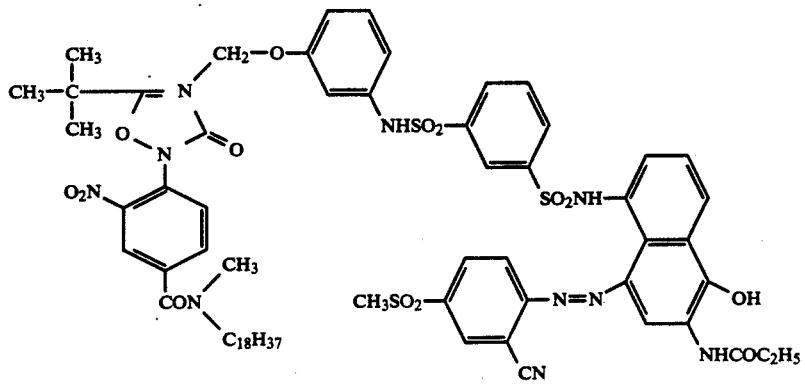

-continued
(4)
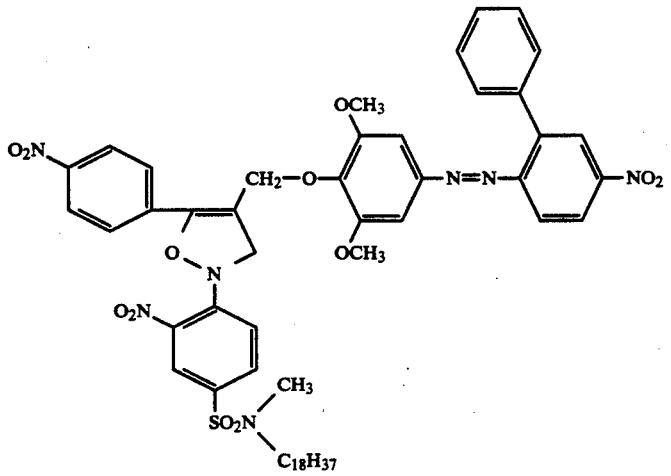
(5)
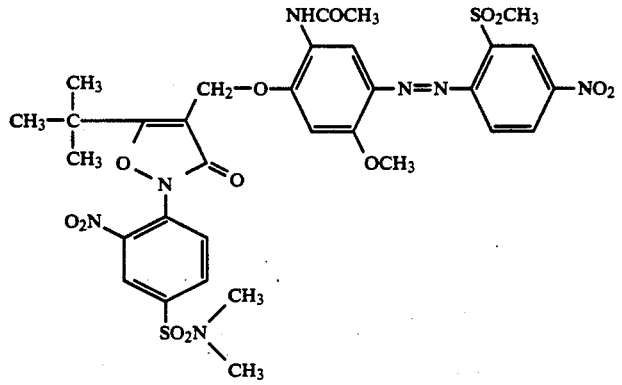
(6)
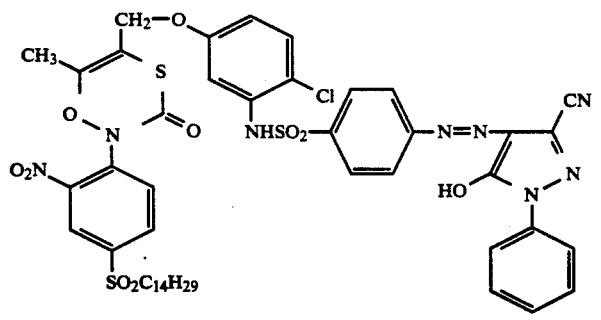
(7)
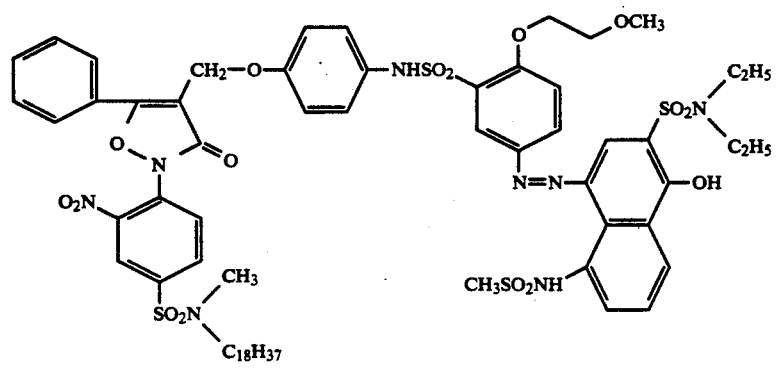

-continued
(8)
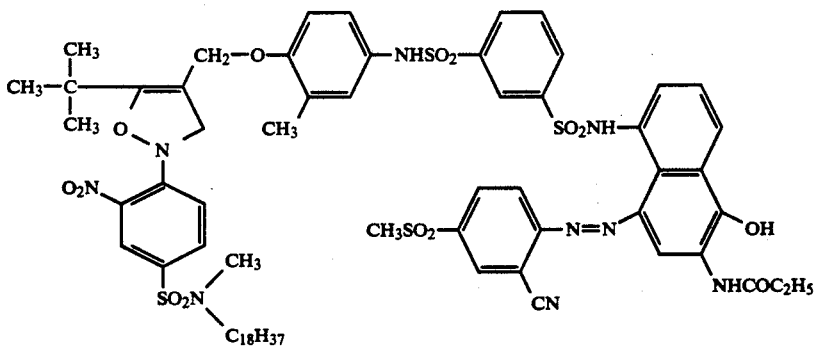
(9)
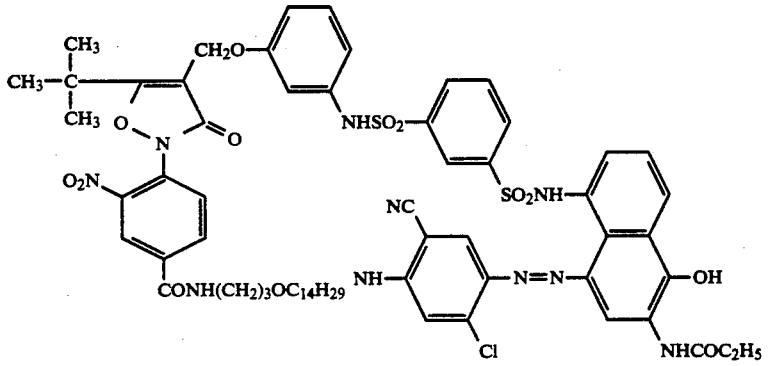
(10)
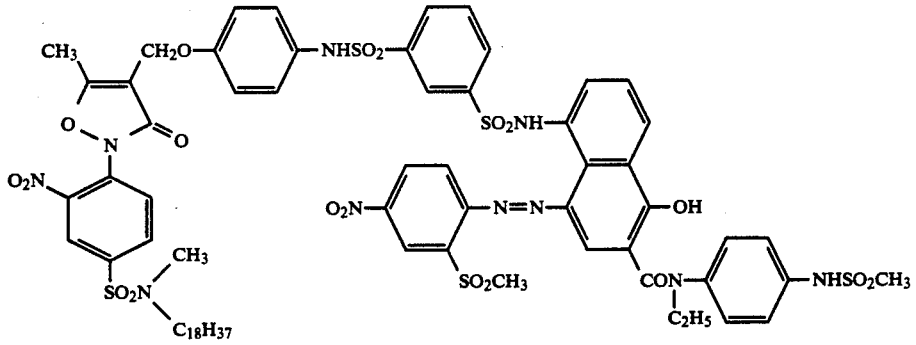
(11)
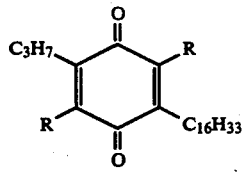
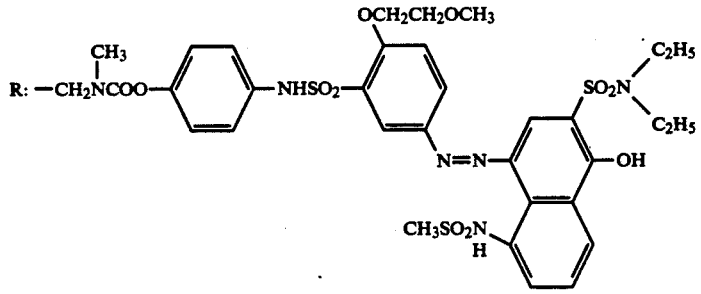

-continued (12)

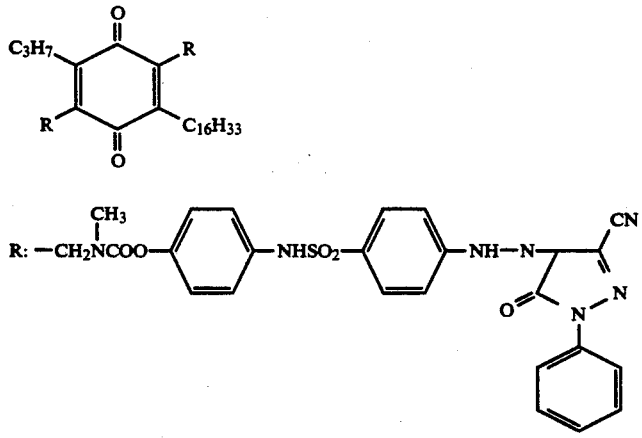

(13)

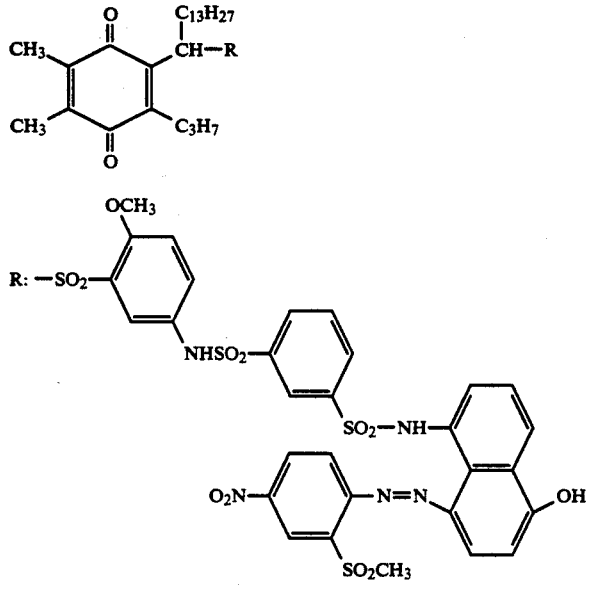

The silver halide for use in preparation of the photographic material of the present invention may be anyone of silver chloride, silver bromide, silver iodobromide, silver chlorobromide, silver chloroiodide and silver chloroiodobromide.

The silver halide emulsion for use in the present invention may be either a surface latent image type emulsion or an internal latent image type emulsion. The internal latent image type emulsion is used as a direct reversal emulsion in combination with a nucleating agent and a photo-foggant. A so-called core/shell emulsion in which the grains have different phases in the inside (core) and the surface part (shell) may also be used in the present invention. The silver halide emulsion may be either monodispersed or polydispersed, or a mixture of monodispersed emulsions may also be used. The grain size is preferably from 0.1 to 2 μm, especially preferably from 0.2 to 1.5 μm. Regarding the crystal habit of the silver halide grains, the grains may be cubic, octahedral or tetradecahedral, or they may even be tabular grains having a high aspect ratio.

Concretely, any of the silver halide emulsions described in U.S. Pat. No. 4,500,626, *Research Disclosure,* (hereinafter referred to as "RD") 17029 (1978), U.S. Pat. No. 4,628,021 and JP-A-60-196748, JP-A-60-192937 and JP-A-60-2585357 may be used in the present invention.

The silver halide emulsion may be used in the form of a primitive emulsion but is generally chemically sensitized before use. For chemical sensitization of the emulsion, sulfur sensitization, reduction sensitization or noble metal sensitization which is known for emulsion for conventional photographic materials may be utilized singly or in combination. Such chemical sensitization may be effected in the presence of a nitrogen-containing heterocyclic compound (JP-A-58-126526 and JP-A-58-215644).

In preparation of the photographic material of the present invention, the amount of the light-sensitive silver halide to be coated is from 1 mg/m$^2$ to 10 g/m$^2$ as silver.

In accordance with the present invention, an organic metal salt may be used as an oxidizing agent together with the light-sensitive silver halide. For such organic metal salts, organic silver salts are especially preferred.

As organic compounds which may be used for forming the organic silver salt oxidizing agents, there are the benzotriazoles, fatty acids and other compounds described in U.S. Pat. No. 4,500,626, columns 52 and 53. In addition, the silver salts of alkynyl group-containing carboxylic acids such as silver phenylpropionate described in JP-A-60-113235 and the silver acetylene described in JP-A-61-249044 are also useful. The organic silver salts may be used in combinations of two or more kinds.

The said organic silver salt may be used in an amount of from 0.01 to 10 mols, preferably from 0.01 to 1 mol, per mol of the light-sensitive silver halide. The total of the light-sensitive silver halide and the organic silver salt to be coated is suitably from 50 $mg/m^2$ to 10 $g/m^2$ as silver.

Various kinds of anti-foggants or photographic stabilizers may be incorporated into the photographic materials of the present invention. As examples of such additives, there may be mentioned the azoles and azaindenes described in RD 17643 (1978), pages 24 to 25, the nitrogen-containing carboxylic acids and phosphoric acids described in JP-A-59-168442, the mercapto compounds and metal salts thereof described in JP-A-59-111636, and the acetylene compounds described in JP-A-62-87957.

In accordance with the present invention, an image toning agent may be incorporated into the light-sensitive element, if desired. As examples of effective toning agents, there are the compounds described in JP-A-61-147244, page 24.

The silver halides for use in preparation of the photographic material of the present invention may be spectrally sensitized with methine dyes or the like dyes. Dyes which may be used for the purpose include cyanine dyes, merocyanine dyes, complex cyanine dyes, complex merocyanine dyes, holopolar cyanine dyes, hemicyanine dyes, styryl dyes and hemioxonole dyes.

Concretely, there may be mentioned the sensitizing dyes described in JP-A-59-180550 and JP-A-60-140335 and RD 17029 (1978) pages 12 to 13, as well as the heat-discoloring sensitizing dyes described in JP-A-60-111239 and JP-A-62-32445.

These sensitizing dyes may be used singly or in combinations of two or more. The combinations of the sensitizing dyes are often used for the purpose of supersensitization.

Dyes which do not have a spectrally sensitizing action by themselves or compounds which do not substantially absorb visible light but show a supersensitizing action may also be incorporated into the emulsions for use in the present invention, together with the sensitizing dyes. (For examples, the compounds described in U.S. Pat. Nos. 2,933,390, 3,635,721, 3,743,510, 3,615,613, 3,615,641, 3,617,295 and 3,635,721 can be used for the purpose.)

The time of adding the sensitizing dye to the emulsion may be during chemical ripening of the emulsion or before or after chemical ripening thereof, or alternatively, the dye may also be added to the emulsion before or after the formation of the nuclei of silver halide grains in accordance with U.S. Pat. Nos. 4,183,756 and 4,225,666. The amount of the dye to be added is generally from $10^{-8}$ to $10^{-2}$ mol or so per mol of the silver halide.

As the binder for the heat-developing light-sensitive element of the present invention, a hydrophilic substance is preferably used. As the hydrophilic binder, a transparent or semi-transparent substance is preferred. As examples of preferred binders, there may be mentioned natural compounds such as gelatin, gelatin derivatives and the like proteins as well as cellulose derivatives, starches, gum arabic, dextran, pullulane and the like polysaccharides; and synthetic polymer compounds such as polyvinyl alcohol, polyvinyl pyrrolidone, partial saponified products of vinyl alcohol/acrylic acid copolymer, acrylamide polymer and the water-soluble polyvinyl compounds described in JP-A-62-245260. The binders may be used in the form of a combination of two or more kinds. In addition to the binder, a vinyl compound dispersion may also be incorporated into the photographic material so as to increase the dimension stability of the material, the dispersion being used in the form of a latex.

In accordance with the present invention, the amount of the binder to be coated is preferably 20 g or less, especially preferably 10 g or less, more preferably 7 g or less, per $m^2$ of the material.

In preparation of the photographic material of the present invention, the hydrophobic additives such as the reducible dye-forming compound and the electron-donating substance may be incorporated into the light-sensitive element by a known method, for example, in accordance with the method described in U.S. Pat. No. 2,322,027. In this case, the high boiling point organic solvents described in JP-A-59-83154, JP-A-59-178451, JP-A-59-178452, JP-A-59-178453, JP-A-59-178454, JP-A-59-178455 and JP-A-59-178457 may be used optionally together with a low boiling point organic solvent having a boiling point of from 50° C. to 160° C.

The amount of the high boiling point organic solvent to be used is 10 g or less, preferably 5 g or less, per g of the dye-forming compound used. This is suitably 1 cc or less, especially 0.5 cc or less, more suitably 0.3 cc or less, per g of the binder used.

The dispersion method using a polymer described in JP-B-51-39853 (the term "JP-B" as used herein means an "examined Japanese patent publication") and JP-A-51-59943 may also be used in preparation of the photographic material of the present invention.

When the additives to be added to the photographic material of the present invention are substantially insoluble in water, these may be dispersed in a binder in the form of fine grains and the resulting dispersion may be added to the coating emulsion, in addition to the above-mentioned methods.

When the hydrophobic compound is dispersed in a hydrophilic colloid, various surfactants may be used. For example, the surfactants described in JP-A-59-157636, pages 37 to 38 may be used for the purpose.

In the present invention, compounds which may improve the developability and which may improve the stability of images formed may be added to the light-sensitive element. Examples of such compounds which are preferably used for the purpose are described in U.S. Pat. No. 4,500,626, columns 51 to 52.

In a system of forming an image by diffusion transfer of a dye, a dye-fixing element is used together with the light-sensitive element. The dye-fixing element may be in the form of being coated on a different support separately from the light-sensitive element or alternatively this may be in the form of being coated on the same support having the light-sensitive element. Regarding the relation between the light-sensitive element and the dye-fixing element, the relation between the elements and the support and the relation between the elements and a white reflective layer, the description of U.S. Pat. No. 4,500,626, column 57 may apply to the present invention.

The dye-fixing element which is preferably used in the present invention has at least one layer containing a mordant agent and a binder. As the mordant agent, substances which are known in the photographic field can be used. As specific examples of the agents, there may be mentioned the mordant agents described in U.S. Pat. No. 4,500,626, columns 58 to 59 and JP-A-61-88256, pages 32 to 41; and the compounds described in JP-A-60-118834, JP-A-60-119557, JP-A-60-235134 and Japanese Patent Application Nos. 61-87180 and 61-87181. In addition, the dye-accepting polymer compounds described in U.S. Pat. No. 4,463,079 may also be used.

The dye-fixing element may optionally have auxiliary layers such as a protective layer, a peeling layer and a curling preventing layer. In particular, provision of a protective layer in the element is advantageous.

As the binder for the constituting layers in the dye-fixing element, the same natural or synthetic polymer substances as the binders for the light-sensitive element may be used.

The light-sensitive element and the dye-fixing element may have, in one or more constituting layers thereof, a heat solvent, a plasticizer, an antifading agent, a UV-absorbent, a lubricant, a mat agent, an antioxidant, a vinyl compound dispersion for improving dimensional stability, a surfactant and a brightening agent, if desired. Examples of these additives are described in JP-A-61-88256, pages 23 to 26. In the case of a system where heat development and dye transference are effected simultaneously in the presence of a small amount of water, it is preferred to incorporate a base and/or a base precursor which will be mentioned hereinafter into the dye-fixing element so as to improve the storage stability of the light-sensitive element.

In the practice of the present invention, the light-sensitive element and/or the dye-fixing element may contain an image formation accelerator. The image formation accelerator has various functions of accelerating the oxidation-reduction reaction between a silver salt oxidizing agent and a reducing agent, accelerating the formation of a dye from a dye-forming substance, the decomposition of the dye therefrom and the reaction of releasing a diffusible dye from a dye-releasing substance, and accelerating the movement of the dye from the light-sensitive layer to the dye-fixing layer. From the physico-chemical functions, the image formation accelerator is classified into a group of bases or base precursors, a group of nucleophilic compounds, a group of high boiling point solvents (oils), a group of heat solvents, a group of surfactants, and a group of compounds having a mutual reactivity with silver or silver ion. However, the substances of the groups generally have two or more functions at a time, and it is general that these substances have two or more of the said acceleration capacities. The details of these substances are described in U.S. Pat. No. 4,678,739, pages 38 to 40.

As base precursors, there are salts of organic acids which may be decarboxylated under heat and bases, and compounds capable of releasing amines by intramolecular nucleophilic substitution reaction, Lossen rearrangement or Beckmann rearrangement. Specific examples of these compounds are described in U.S. Pat. No. 4,511,493 and JP-A-62-65038. In addition to these compounds, the combination of a hardly soluble metal compound and a compound capable of reacting with the metal ion which constitutes the hardly soluble metal compound formation of a complex (the compound being called a "complex-forming compound") as described in European Patent Application Laid-Open No. 210,660, as well as the compounds capable of generating a base by electrolysis described in JP-A-61-232451 may also be used as a base precursor. In particular, the former combination is effective. It is advantageous that the hardly soluble metal compound and the complex-forming compounds are separately added to the light-sensitive element and the dye-fixing element, individually.

The light-sensitive element and/or the dye-fixing element for use in the present invention may contain various kinds of development stopping agents for the purpose of always obtaining a constant image irrespective of the processing temperature and the processing time in development.

The development stopping agent as referred to herein means a compound which may immediately neutralize a base or react with a base, after necessary development, to lower the base concentration in the photographic film processed so as to step the development, or a compound which mutually reacts with silver or a silver salt to control the development. Concretely, there may be mentioned, for example, an acid precursor which may release an acid under heat, an electrophilic compound which may react with the coexisting base under heat for substitution reaction, as well as a nitrogen-containing heterocyclic compound and a mercapto compound and precursors thereof. Precisely, the compounds described in U.S. Pat. Nos. 4,670,373, 4,656,126, 4,610,957, 4,626,499, 4,678,735 and 4,639,408, JP-A-61-147249, JP-A-61-147244, JP-A-61-184539, JP-A-61-185743, JP-A-61-185744, JP-A-61-188540, JP-A-61-269148 and JP-A-61-269143 may be used for the purpose.

The dye-fixing element is preferably stored under the condition of a relative humidity of from 25 to 85%.

In the light-sensitive element and/or the dye-fixing element of the present invention, the constituting layers (photographic emulsion layer, dye-fixing layer) may contain an inorganic or organic hardening agent.

Specific examples of the hardening agent which may be used in the present invention are described in U.S. Pat. No. 4,678,739, column 41 and JP-A-59-116655, and the compounds can be used singly or in combinations of two or more.

The support for the light-sensitive element and/or the dye-fixing element of the present invention must be such that it is durable to the processing temperature. As general supports, not only glass, paper, polymer films, metals and analogues thereof but also the supports described in JP-A-61-147244, page 25 may be used for the materials of the present invention.

The light-sensitive element and/or the dye-fixing element may be in the form that has therein an electroconductive heater layer as a heating means for heat development or diffusion transfer of the dye formed.

In this case, a transparent or opaque heating element may be prepared in accordance with a conventional technique which is known for formation of a resistance heater. For formation of a resistance heater, a method of using a thin film of a semiconductive inorganic material as well as a method of using a thin film of an organic substance which contains fine electroconductive grains as dispersed in a binder may be employed.

The materials which may be utilized in the methods are described in JP-A-61-145544. The electro-conductive layer thus formed may also function as an antistatic layer.

In preparation of the photographic materials of the present invention, the method described in U.S. Pat. No. 4,500,626 may be employed for coating the heat-developing light-sensitive layer, the protective layer, the interlayer, the subbing layer, the blacking layer, the dye-fixing layer and other layers on a support.

As a light source for imagewise exposure of the photographic material of the present invention to record an imager thereon, radiations inclusive of visible rays may be used. In general, various light sources which are used in general color prints, for example, a tungsten lamp, mercury lamp, halogen lamp such as an iodine lamp, xenon lamp, laser ray, CRT ray, light-emitting diode (LED) as well as the light sources described in U.S. Pat. No. 4,500,626, can be used for the photographic materials of the present invention.

The heating temperature in the heat development step can be from about 50° C. to about 250° C., and advantageously from about 80° C. to about 180° C. The diffusion transference of the dye formed may be effected simultaneously with heat development or may be effected after heat development. In the latter case, the heating temperature in the transfer step may be from the temperature in the heat development step to room temperature but is more preferably from 50° C. up to the temperature which is lower than the temperature in the heat development by about 10° C.

The transference of the dye formed may be effected only by heating, but a solvent may be used so as to accelerate the transference of the dye.

In addition, a method of simultaneous or continuous development and transfer by heating in the presence of a small amount of a solvent (especially water) is also advantageous, which is described in detail in JP-A-59-218443 and JP-A-61-238056. In accordance with the system, the heating temperature is preferably from 50° C. to the boiling point of the solvent. For instance, when water is used as a solvent, the temperature is desirably from 50° C. to 100° C.

As examples of the solvent to be used for acceleration of development and/or transference of the diffusible dye to the dye-fixing layer, there may be mentioned water and an aqueous basic solution containing an inorganic alkali metal salt or an organic base. As the bases to be incorporated into the solution, those mentioned for the aforesaid image formation accelerators may be used. In addition, a low boiling point solvent as well as a mixed solution comprising a low boiling solvent and water or an aqueous base-containing solution may also be used. If desired, a surfactant, an antifoggant, a hardly soluble metal salt and a complex-forming compound may be incorporated into the solvent.

The solvent may be applied to either the dye-fixing element or the light-sensitive element or to both of them. The amount of the solvent to be added thereto may be small, or that is, less than the weight of the solvent which corresponds to the maximum swollen volume of the total coated film (and in particular, less than the amount obtained by subtracting the weight of the total coated film from the weight of the solvent which corresponds to the maximum swollen volume of the total coated film).

As a method for applying a solvent to the light-sensitive layer or the dye-fixing layer, for example, there is the method described in JP-A-61-147244, page 26. As another method, a solvent may previously be incorporated into the light-sensitive element or the dye-fixing element or into both of them in the form of solvent-containing microcapsules.

In order to accelerate the transference of the dye to the dye-fixing layer, a hydrophilic heat solvent which is solid at normal temperature but may be melted at a high temperature may be incorporated into the light-sensitive element or the dye-fixing element. The hydrophilic heat solvent may be incorporated into either the light-sensitive element or the dye-fixing element or may also be incorporated into both of them. For incorporation of the solvent into the said element(s), the solvent may be added to anyone of the emulsion layer, interlayer, protective layer and dye-fixing layer, but is preferably added to the dye-fixing layer and/or the adjacent layers.

As examples of the hydrophilic heat solvents which may be used for the purpose, there are ureas, pyridines, amides, sulfonamides, imides, alcohols, oximes and other heterocyclic compounds.

In order to accelerate the dye transfer, a high boiling point organic solvent may be incorporated into the light-sensitive element and/or the dye-fixing element.

As a heating means in the development and/or transfer steps, the means described in JP-A-61-147244, pages 26 to 27, such as hot plate, iron and hot roller, may be used.

When the light-sensitive element and the dye-fixing element are attached to each other under pressure, the pressure condition and the means of applying a pressure to the attached elements described in JP-A-61-147244, page 27 may apply to the case of the present invention.

Any and every heat development apparatus may be used for processing the photographic materials of the present invention. For example, the apparatus described in JP-A-59-75247, JP-A-59-177547, JP-A-59-181353 and JP-A-60-18951 and JP-A-U-62-25944 (the term "JP-A-U" as used herein means an "unexamined published Japanese utility model application") are preferably used for the photographic materials of the present invention.

The photographic material of the present invention may give a positive color image on the dye-fixing element by a heat development-transfer step. The processed photographic material (in the case having a light-sensitive element and a dye-fixing element on the same support, the dye-fixing element is peeled off from the light-sensitive element after the material has been processed) still has a negative image based on the silver halide and developed silver together with the non-reacted dye-forming compound. Accordingly, using the negative image, the processed photographic material of the present invention may be printed onto a general color paper. More precisely, the photographic material as processed by heat development and dye transfer is desilvered with a known bleach-fixing solution or a bleaching solution and a fixing solution and thereafter this is post-treated (e.g., rinsed with water) and dried to obtain a negative color image. That is, the photographic material of the present invention may be utilized not only for giving a positive image by heat development and dye transfer process but also as a negative photographic material for extra prints.

The following examples are intended to illustrate the present invention in more detail but not to limit it in any way.

Unless otherwise indicated, all percents, ratios, parts, etc. are by weight.

EXAMPLE 1

Multilayer color photographic material samples each having the composition mentioned below were prepared.

Emulsion (I) for the first layer was prepared as follows.

600 ml of an aqueous solution containing sodium chloride and potassium bromide and an aqueous silver nitrate solution (formed by dissolving 0.59 mol of silver nitrate in 600 ml of water) were simultaneously added to a well stirred aqueous gelatin solution (containing 20 g of gelatin and 3 g of sodium chloride in 1000 ml of water and kept at 75° C.), at the same flow rate over a period of 40 minutes. Thus a monodispersed cubic silver chlorobromide emulsion (bromine 80 mol %) having a mean grain size of 0.35 μm was prepared.

After being washed with water and desalted, 5 mg of sodium thiosulfate and 20 mg of 4-hydroxy-6-methyl-1,3,3a,7 -tetrazaindene were added to the emulsion to chemically sensitize the same at 60° C. The yield of the emulsion was 600 g.

Emulsion (II) for the third layer was prepared as follows.

600 ml of an aqueous solution containing sodium chloride and potassium bromide, an aqueous silver nitrate solution (formed by dissolving 0.59 mol of silver nitrate in 600 ml of water) and the dye solution (I) mentioned below were simultaneously added to a well stirred aqueous gelatin solution (containing 20 g of gelatin and 3 g of sodium chloride in 1000 ml of water and kept at 75° C.), at the same flow rate over a period of 40 minutes. Thus a dye-adsorbed monodispersed cubic silver chlorobromide emulsion (bromine 80 mol %) having a mean grain size of 0.35 μm was prepared.

After being washed with water and desalted, 5 mg of sodium thiosulfate and 20 mg of 4-hydroxy-6-methyl-1,3,3a,7-tetrazaindene were added to the emulsion to chemically sensitize the same at 60° C. The yield of the emulsion was 600 g. Dye Solution (I):

Dye having the following structure formula: 160 mg

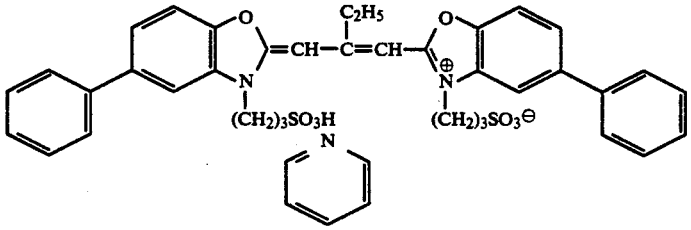

Methanol: 400 ml

Emulsion (III) for the fifth layer was prepared as follows.

1000 ml of an aqueous solution containing potassium iodide and potassium bromide and an aqueous silver nitrate solution (formed by dissolving 1 mol of silver nitrate in 1000 ml of water) were simultaneously added to a well stirred aqueous gelatin solution (containing 20 g of gelatin and ammonia in 1000 ml of water and kept at 50° C.), whereupon the pAg value in the reaction system was kept constant. Thus a monodispersed octahedral silver iodobromide emulsion (iodine 5 mol %) having a mean grain size of 0.5 μm was prepared.

After being washed with water and desalted, 5 mg of chloroauric acid (tetra-hydrate) and 2 mg of sodium thiosulfate were added to the emulsion for gold and sulfur sensitization of the same at 60° C. The yield of the emulsion was 1 kg.

Next, a gelatin dispersion containing a dye-forming substance was prepared as follows.

18 g of Yellow Dye-forming Substance (1), 9 g of Electron-donating Substance (ED-9) and 9 g of tricyclohexyl phosphate were weighed, and 46 ml of cyclohexanone was added thereto and heated to dissolve them at about 60° C. to prepare a uniform solution. The resulting solution was blended with 100 g of a 10% lime-processed gelatin solution, 60 cc of water and 1.5 g of sodium dodecylbenzenesulfonate with stirring and then the resulting mixture was homogenized in a homogenizer at 10000 rpm for 10 minutes. The dispersion thus obtained was called an yellow dye-forming substance dispersion.

In the same manner as preparation of the yellow dye-forming substance dispersion, except that Magenta Dye-forming Substance (2) or Cyan Dye-forming Substance (9) was used in place of the Yellow Dye-forming Substance (1), a magenta dye-forming substance dispersion and a cyan dye-forming substance dispersion were prepared.

Using the thus prepared emulsions and compositions, various multilayer color photographic material samples having the layer constitution mentioned below were prepared.

The amount of the electron-transferring agent and that of the electron-transferring agent precursor in the first layer, third layer and fifth layer were varied as shown in Table 1 below. Thus photographic material samples Nos. 101, 102 and 103 were prepared.

| Layer Constitution: | (g/m²) |
|---|---|
| Sixth Layer: Protective Layer | |
| Gelatin | 0.91 |
| Mat agent (Silica) | 0.03 |
| Water soluble polymer (1)* | 0.23 |
| Surfactant (1)* | 0.06 |
| Surfactant (2)* | 0.13 |
| Hardening agent (1)* | 0.01 |
| $ZnSO_4.7H_2O$ | 0.06 |
| Fifth Layer: Blue-sensitive Layer | |
| Emulsion (III) | 0.58 as Ag |
| Gelatin | 0.68 |
| Anti-foggant (1)* | $1.36 \times 10^{-3}$ |
| Yellow Dye-forming substance (1) | 0.50 |
| High boiling point organic solvent (1)* | 0.25 |
| Electron-donating substance (ED-9) | 0.25 |
| Surfactant (3)* | 0.05 |
| Electron-transferring agent (X-34) | See Table 1 |
| Electron-transferring agent precursor (ETP-34-34) | See Table 1 |
| Hardening agent (1)* | 0.01 |
| Water-soluble polymer (2)* | 0.02 |
| Fourth Layer: Interlayer | |
| Gelatin | 0.75 |
| $Zn(OH)_2$ | 0.32 |
| Reducing agent (1)* | 0.11 |
| Surfactant (1)* | 0.02 |
| Surfactant (4) | 0.07 |

-continued

| Layer Constitution: | (g/m²) |
|---|---|
| Water-soluble polymer (2)* | 0.02 |
| Hardening agent (1)* | 0.01 |
| Third Layer: Green-sensitive Layer | |
| Emulsion (II) | 0.41 as Ag |
| Gelatin | 0.47 |
| Anti-foggant (1)* | $1.25 \times 10^{-3}$ |
| Magenta Dye-forming substance (2) | 0.37 |
| High boiling point organic solvent (1)* | 0.19 |
| Electron-donating substance (ED-9) | 0.14 |
| Surfactant (3)* | 0.04 |
| Electron-transferring agent (X-34) | See Table 1 |
| Electron-transferring agent precursor (ETP-34-34) | See Table 1 |
| Hardening agent (1)* | 0.01 |
| Water-soluble polymer (2)* | 0.02 |
| Second Layer: Interlayer | |
| Gelatin | 0.80 |
| $Zn(OH)_2$ | 0.31 |
| Reducing agent (1)* | 0.11 |
| Surfactant (1)* | 0.06 |
| Surfactant (4)* | 0.10 |
| Water-soluble polymer (2)* | 0.03 |

-continued

| Layer Constitution: | (g/m²) |
|---|---|
| Hardening agent (1)* | 0.01 |
| First Layer: Red-sensitive Layer | |
| Emulsion (I) | 0.36 as Ag |
| Sensitizing dye (1)* | $1.07 \times 10^{-3}$ |
| Gelatin | 0.49 |
| Anti-foggant (1)* | $1.25 \times 10^{-3}$ |
| Cyan dye-forming substance (9) | 0.40 |
| High boiling point organic solvent (1)* | 0.18 |
| Electron-donating substance (ED-9) | 0.14 |
| Surfactant (3)* | 0.04 |
| Electron-transferring agen (X-34) | See Table 1 |
| Electron-transferring agent precursor (ETP-34-34) | See Table 1 |
| Hardening agent (1)* | 0.01 |
| Water-soluble polymer (2)* | 0.02 |
| Support: | |
| Polyethylene terephthalate (thickness 100 μm) | |
| Backing Layer: | |
| Carbon black | 0.44 |
| Polyester | 0.30 |
| Polyvinyl chloride | 0.30 |

The components used were as follows.

Water-soluble Polymer (1)*: Sumika Gel L-5 (H) (manufactured by Sumitomo Chemical)

Water-soluble Polymer (2)*:

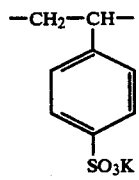

Surfactant (1)*: Aerosol OT

Surfactant (2)*:

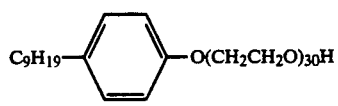

Surfactant (3)*:

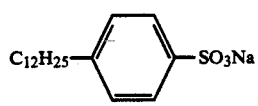

Surfactant (4)*:

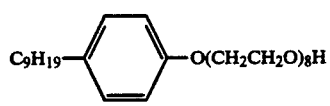

Hardening Agent (1)*: 1,2-bis(vinylsulfonylacetamido)ethane

High Boiling Point Organic Solvent (1)*: Tricyclohexyl Phosphate

Anti-foggant (1)*:

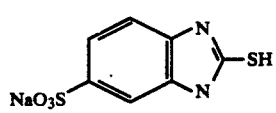

Sensitizing Dye (1)*:

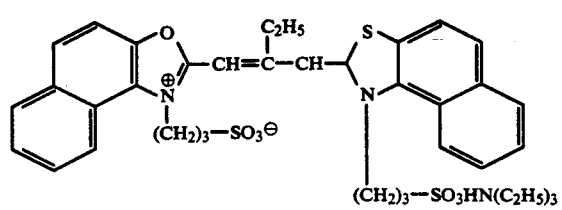

-continued

Reducing Agent (1)*:

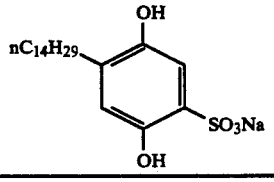

Next, a dye-fixing material sample (R-1) was prepared by forming the layers each having the composition mentioned below on a polyethylene-laminated paper support.

| Layer Constitution: | (g/m²) |
|---|---|
| Third Layer: | |
| Gelatin | 0.05 |
| Mat agent (Silica) | 0.02 |
| Silicone oil (*1) | 0.04 |
| Surfactant (*2) | 0.001 |
| Surfactant (*3) | 0.02 |
| Surfactant (*4) | 0.10 |
| Guanidine picolinate | 0.45 |
| Polymer (*5) | 0.24 |
| Second Layer: | |
| Mordant agent (*6) | 2.35 |
| Polymer (*7) | 0.60 |
| Gelatin | 1.40 |
| Polymer (*5) | 0.21 |
| High boiling point organic solvent (*8) | 1.40 |
| Guanidine picolinate | 1.80 |
| Surfactant (*2) | 0.02 |
| First Layer: | |
| Gelatin | 0.45 |
| Surfactant (*4) | 0.01 |
| Polymer (*5) | 0.04 |
| Hardening agent (*9) | 0.30 |
| Support: | |
| Polyethylene-laminated Paper Support | (thickness 170 μm) |
| First Backing Layer: | |
| Gelatin | 3.25 |
| Hardening agent (*9) | 0.25 |
| Second Backing Layer: | |
| Gelatin | 0.44 |
| Silicone oil (*1) | 0.08 |
| Surfactant (*5) | 0.002 |

-continued

| Layer Constitution: | (g/m²) |
|---|---|
| Mat agent (*10) | 0.09 |

The compounds used were as follows.

Silicone Oil (*1):

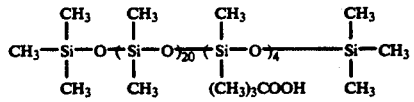

Surfactant (*2): Aerosol OT

Surfactant (*3):

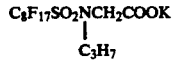

Surfactant (*4):

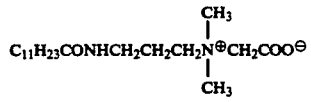

Surfactant (*5):

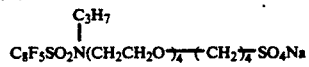

Polymer (*5): Vinyl Alcohol/Sodium acrylate Copolymer (75/25, by mol)

Polymer (*7): Dextran (molecular weight 70,000)

Mordant Agent (*6):

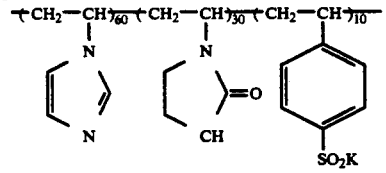

High Boiling Point Organic Solvent (*8): Reofos 95 (manufactured by Ajinomoto Co.)

Hardening Agent (*9):

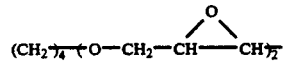

Mat Agent (*10): Benzoguanamine Resin (mean grain size 15 μm)

The multilayer color photographic material samples were exposed with a tungsten lamp (5000 lux) through a blue-green-red-gray color separation filter with continuous color density variation, for 1/10 second.

After exposure, water (15 ml/m²) was applied to the emulsion surface of the thus exposed sample with a wire bar, while the sample was conveyed at a linear velocity of 20 mm/sec, and then immediately this was attached to the image-receiving material (dye-fixing material (R-1)) with both coated surfaces facing each other.

The thus attached sample was heated with a heat roller which was so adjusted that the temperature of the water absorbed layer could be 85° C., for 15 seconds. Next, the image-receiving material was peeled off, whereby a sharp image with blue, green, red and green colors corresponding to the color separation filter was evenly formed on the material.

The maximum density ($D_{max}$) and the minimum density ($D_{min}$) of each of the cyan, magenta and yellow colors in the gray part were measured, and the results obtained are shown in Table 1 below.

TABLE 1

| Sample No. | Electron-transferring Agent 1st, 3rd and 5th layers ($g/m^2$) | Electron-tranferring Agent Precursor 1st, 3rd and 5th layers ($g/m^2$) | $D_{max}$ Yellow | $D_{max}$ Magenta | $D_{max}$ Cyan | $D_{min}$ Yellow | $D_{min}$ Magenta | $D_{min}$ Cyan |
|---|---|---|---|---|---|---|---|---|
| 101 | 0.03 | 0 | 2.10 | 2.00 | 2.25 | 0.18 | 0.16 | 0.15 |
| 102 | 0.06 | 0 | 2.00 | 1.98 | 2.31 | 0.16 | 0.15 | 0.15 |
| 103 | 0 | 0.05 | 2.05 | 2.06 | 2.23 | 0.60 | 0.61 | 0.58 |

From the results shown in Table 1 above, it is understood that the use of the electron-transferring agent precursor alone resulted in a high $D_{min}$ value so that an image with a good S/N ratio could not be obtained. On the contrary, images which were satisfactory both in $D_{max}$ and $D_{min}$ were obtained in the sample NOS. 101 and 102.

Next, the composition of the electron-transferring agent and the electron-transferring agent precursor in the first, third and fifth layers in the sample No. 101 was varied as indicated in Table 2 below, while the others were same as those in the sample No. 101. Thus other photographic material sample Nos. 104 to 109 were prepared. The sample Nos. 101 and 104 to 109 were stored for 7 days under the conditions of a temperature of 40° C. and a humidity of 70% (storage condition (A)) or under the condition of a temperature of 50° C. and a humidity of 30% (storage condition (B)). The thus stored samples were processed in the same manner as described above, and the $D_{max}$ and $D_{min}$ values of the cyan, magenta and yellow colors in the gray part in the images obtained were measured analogously. The results obtained are shown in Table 3.

The photographic properties of sample Nos. 104 to 109 in a fresh state immediately after preparation were same as those of the fresh sample No. 101.

TABLE 2

| Sample No. | Electron-transferring Agent (*) | Electron-transferring Agent Precursor (*) | Amount of Electron-transferring Agent (*) ($g/m^2$) | Amount of Electron-transferring Agent Precursor (*) ($g/m^2$) |
|---|---|---|---|---|
| 101 | X-34 | — | 0.03 | 0 |
| 104 | " | ETP-34-11 | " | 0.03 |
| 105 | " | ETP-34-34 | " | 0.05 |
| 106 | " | ETP-34-43 | " | 0.06 |
| 107 | " | ETP-34-31 | " | 0.06 |
| 108 | " | ETP-34-50 | " | 0.04 |
| 109 | " | ETP-34-47 | " | 0.06 |

(*) 1st, 3rd and 5th layers

TABLE 3

| Sample No. | Storage Condition | $D_{max}$ Yellow | $D_{max}$ Magenta | $D_{max}$ Cyan | $D_{min}$ Yellow | $D_{min}$ Magenta | $D_{min}$ Cyan |
|---|---|---|---|---|---|---|---|
| 101 | | 2.09 | 2.05 | 2.32 | 0.45 | 0.41 | 0.43 |
| 104 | A | 2.03 | 2.05 | 2.23 | 0.28 | 0.23 | 0.25 |
| 105 | 40° C. | 2.08 | 2.06 | 2.25 | 0.19 | 0.18 | 0.17 |
| | 70% | | | | | | |
| 106 | 7 days | 2.05 | 2.03 | 2.27 | 0.27 | 0.24 | 0.26 |
| 107 | | 2.06 | 2.05 | 2.31 | 0.18 | 0.17 | 0.18 |
| 108 | | 2.05 | 2.07 | 2.30 | 0.19 | 0.17 | 0.18 |
| 109 | | 2.07 | 2.04 | 2.29 | 0.18 | 0.18 | 0.17 |
| 101 | | 2.01 | 2.04 | 2.12 | 0.48 | 0.49 | 0.47 |
| 104 | B | 2.00 | 2.02 | 2.04 | 0.30 | 0.25 | 0.26 |
| 105 | 50° C. | 2.00 | 2.00 | 2.03 | 0.20 | 0.18 | 0.16 |
| | 40% | | | | | | |
| 106 | 7 days | 1.97 | 2.01 | 2.02 | 0.29 | 0.25 | 0.27 |
| 107 | | 2.01 | 2.03 | 2.10 | 0.20 | 0.19 | 0.16 |
| 108 | | 1.98 | 2.04 | 2.11 | 0.21 | 0.18 | 0.17 |
| 109 | | 1.99 | 2.00 | 2.09 | 0.19 | 0.18 | 0.17 |

As is obvious from the results shown in Table 3 above, $D_{min}$ was lower in sample Nos. 104 to 109 containing both electron-transferring agent and electron-transferring agent precursor than in sample No. 101 having electron-transferring agent only, when the samples were photographically processed after being stored. Accordingly, it is understood that heat-developing color photographic materials containing both electron-transferring agent and electron-transferring agent precursor may give an image with a low $D_{min}$ value and a good S/N ratio, even when they are photographically processed after being stored for a certain period of time.

Regarding the time-dependent $D_{min}$ value in the sample Nos. 104 to 109, it is noted from the results in Table 3 that the $D_{min}$ value in the samples 105 and 107 to 109 was lower than that in the samples 104 and 106. The relative decomposition speed of the electron-transferring agent precursor used in sample Nos. 104 to 109 to the electron-transferring agent X-34 in the layer of the photographic material is shown in Table 4 below.

TABLE 4

| Sample No. | Electron-Transferring Agent (Precursor) | Decomposition Speed (40° C., 70%, 7 days) | Decomposition Speed (50° C., 40%, 7 days) |
|---|---|---|---|
| | X-34 | 1 | 1 |
| 104 | ETP-34-11 | 150 | 90 |
| 108 | ETP-34-50 | 4.8 | 5 |

TABLE 4-continued

| Sample No. | Electron-Transferring Agent (Precursor) | Decomposition Speed (40° C., 70%, 7 days) | Decomposition Speed (50° C., 40%, 7 days) |
|---|---|---|---|
| 107 | ETP-34-31 | 1.6 | 1.8 |
| 105 | ETP-34-34 | 0.9 | 0.9 |
| 109 | ETP-34-47 | 0.2 | 0.3 |
| 106 | ETP-34-43 | 0.01 | 0.02 |

From the results in Tables 3 and 4, it is understood that the combination of electron-transferring agent and electron-transferring agent precursor in which the relative decomposition speed of the precursor is from 0.1 to 5 times or so of the corresponding electron-transferring agent is especially preferred.

EXAMPLE 2

In the same manner as preparation of the sample No. 105, except that the electron-transferring agent precursor ETP-34-34 was replaced by the same molar amount of another electron-transferring agent precursor ETP-34-342, ETP-34-33, ETP-34-35, ETP-34-36 or ETP-34-40, which has a relative decomposition speed of from 0.1 to 5 times of the corresponding electron-transferring agent X-34, other photographic material sample Nos. 201 to 205 were prepared. These samples were stored under the conditions (A) or (B) described in Example 1 and then photographically processed in the same manner as in Example 1. As a result, all the samples gave an image with a good S/N ratio.

EXAMPLE 3

In the same manner as preparation of sample No. 101, except that the electron-transferring agent and electron-transferring agent precursor were added to the layers as indicated in Table 5 below, other photographic material sample Nos. 201 to 206 were prepared.

TABLE 5

| | Amount added per one layer | | | | | | | |
|---|---|---|---|---|---|---|---|---|
| | Amount added to 1st, 3rd and 5th layer | | | | Amount added to 2nd and 4th layers | | | |
| Sample No. | Electron-transferring Agent | | Electron-transferring Agent Precursor | | Electron-transferring Agent | | Electron-transferring Agent Precursor | |
| 201 | — | | — | | X-34 | 0.045 | ETP-34-34 | 0.08 |
| 202 | X-34 | 0.03 | — | | — | | ETP-34-34 | 0.08 |
| 203 | — | | ETP-34-34 | 0.05 | X-34 | 0.045 | — | |
| 204 | — | | — | | X-34 | 0.045 | ETP-34-43 | 0.09 |
| 205 | X-34 | 0.03 | — | | — | | ETP-34-43 | 0.09 |
| 206 | — | | ETP-34-43 | 0.06 | X-34 | 0.045 | — | |

Sample Nos. 201 to 206 were stored under the same conditions as described in Example 1 and then photographically processed in the same manner as described in Example 1. As a result, all the samples gave a positive image with a good S/N ratio.

EXAMPLE 4

In the same manner as preparation of sample No. 105, except that the electron-transferring agent X-34 and the electron-transferring agent precursor ETP-34-34 were replaced by the compounds indicated in Table 6 below, other photographic material sample Nos. 301 to 309 were prepared.

TABLE 6

| Sample No. | Electron-transferring Agent Amount added to 1st, 3rd and 5th layers ($g/m^2$) | | Electron-transferring Agent Precursor Amount added to 1st, 3rd and 5th layers ($g/m^2$) | |
|---|---|---|---|---|
| 301 | X-12 | 0.03 | ETP-12-54 | 0.08 |
| 302 | " | " | ETP-12-34 | 0.07 |
| 303 | " | " | ETP-12-68 | 0.09 |
| 304 | X-36 | 0.06 | ETP-36-14 | 0.06 |
| 305 | " | " | ETP-36-6 | 0.07 |
| 306 | " | " | ETP-36-66 | 0.07 |
| 307 | X-52 | 0.05 | ETP-52-6 | 0.08 |
| 308 | " | " | ETP-52-34 | 0.08 |
| 309 | " | " | ETP-52-60 | 0.06 |

The samples were processed, immediately after being prepared and after being stored under the conditions (A) or (B), in the same manner as described in Example 1. As a result, these gave a positive color image with a good S/N ratio under any condition.

EXAMPLE 5

Using the same emulsions, dye-forming substances, electron-transferring substance and electron-transferring agent as those in sample No. 101 in Example 1, a multilayer color photographic material (sample No. 401) having the layer constitution mentioned below was prepared.

Unless otherwise specifically indicated, the additives were same as those used in sample No. 101.

The organic silver salt emulsion was prepared as follows.

20 g of gelatin and 5.9 g of 4-acetylaminophenylpropiolic acid were dissolved in 1000 ml of an aqueous 0.1% sodium hydroxide solution and 200 ml of ethanol. The resulting solution was stirred at 40° C. A solution of 4.5 g of silver nitrate as dissolved in 200 ml of water was added thereto over a period of 5 minutes. Next, the excess salts were removed by flocculation. Then the pH value of the dispersion was adjusted to 6.3. Thus 300 g of an organic silver salt dispersion was obtained.

Anti-foggant Precursor (1) (*1) having the following structural formula was added to the dye-forming substance in an amount is mols of 0.2 time that of the latter, and the precursor, the dye-forming substance and the electron-donating substance were oil-dispersed before use.

| Layer Constitution: | ($g/m^2$) |
|---|---|
| Sixth Layer: Protective Layer | |
| Gelatin | 0.91 |
| Mat agent (Silica) | 0.03 |
| Surfactant (1)* | 0.06 |
| Surfactant (2)* | 0.13 |
| Hardening agent (1)* | 0.01 |
| Base precursor (1)* | 0.30 |

-continued

| Layer Constitution: | (g/m²) |
|---|---|
| Fifth Layer: Blue-sensitive Layer | |
| Emulsion (III) | 0.30 As Ag |
| Organic silver salt emulsion | 0.25 As Ag |
| Gelatin | 1.00 |
| Anti-foggant precursor (1)* | 0.07 |
| Yellow dye-forming substance (1) | 0.50 |
| High boiling point organic solvent (1)* | 0.75 |
| Electron-donating substance (ED-6) | 0.35 |
| Surfactant (3)* | 0.05 |
| Electron-transferring agent precursor (ETP-34-34) | 0.06 |
| Electron-transferring agent (X-34) | 0.04 |
| Heat solvent (1)* | 0.20 |
| Hardening agent (1)* | 0.01 |
| Base precursor (1)* | 0.27 |
| Water-soluble polymer (2)* | 0.02 |
| Fourth Layer: Interlayer | |
| Gelatin | 0.75 |
| Reducing agent (2)* | 0.24 |
| Surfactant (1)* | 0.02 |
| Surfactant (4)* | 0.07 |
| Water-soluble polymer (2)* | 0.02 |
| Hardening agent (1)* | 0.01 |
| Base precursor (1)* | 0.25 |
| Third Layer: Green-sensitive Layer | |
| Emulsion (II) | 0.20 As Ag |
| Organic silver salt emulsion | 0.20 As Ag |
| Gelatin | 0.85 |
| Anti-foggant precursor (1)* | 0.04 |
| Magenta dye-forming substance (2) | 0.37 |
| High boiling point organic solvent (1)* | 0.55 |
| Electron-donating substance (ED-6) | 0.20 |
| Surfactant (3)* | 0.04 |
| Electron-transferring agent precursor (ETP-34-34) | 0.06 |
| Electron-transferring agent (X-34) | 0.04 |
| Heat solvent (1)* | 0.16 |
| Hardening agent (1)* | 0.01 |
| Base precursor (1)* | 0.25 |
| Water-soluble polymer (2)* | 0.02 |
| Second Layer: Interlayer | |
| Gelatin | 0.80 |
| Reducing agent (2)* | 0.24 |
| Surfactant (1)* | 0.06 |
| Surfactant (4)* | 0.10 |
| Water-soluble polymer (2)* | 0.03 |
| Base precursor (1)* | 0.25 |
| Hardening agent (1)* | 0.01 |
| First Layer: Red-sensitive Layer | |
| Emulsion (I) | 0.20 As Ag |
| Organic silver salt emulsion | 0.20 As Ag |
| Sensitizing dye (1)* | $1.07 \times 10^{-3}$ |
| Gelatin | 0.85 |
| Anti-foggant precursor (1)* | 0.04 |
| Heat solvent (1)* | 0.16 |
| Base precursor (1)* | 0.25 |
| Cyan dye-forming substance (9) | 0.40 |
| High boiling point organic solvent (1)* | 0.60 |
| Electron-donating substance (ED-6) | 0.20 |
| Surfactant (3)* | 0.04 |
| Electron-transferring agent precursor (ETP-34-34) | 0.06 |
| Electron-transferring agent (X-34) | 0.04 |
| Hardening agent (1)* | 0.01 |
| Water-soluble polymer (2)* | 0.02 |
| Support: | |
| Polyethylene terephthalate | (thickness 100 μm) |
| Backing Layer: | |
| Carbon black | 0.44 |
| Polyester | 0.30 |
| Polyvinyl chloride | 0.30 |

The components used were as follows.

Anti-foggant Precursor (1)*

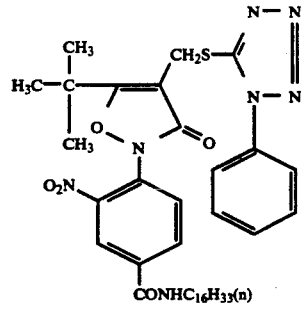

Heat Solvent (1)*: Benzenesulfonamide

Base Precursor (1)*: Guanidine 4-chlorophenylsulfonylacetate

Reducing Agent (2)*:

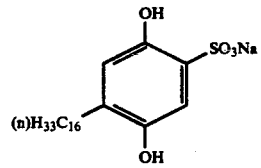

In the same manner as preparation of sample No. 401, except that the electron-transferring agent X-34 was replaced by the same molar amount of the electron-transferring agent X-37, another photographic material sample No. 402 was prepared. Also in the same manner as preparation of sample No. 401, except that the electron-transferring agent precursor ETP-34-34 was replaced by a 1.5 times molar amount of the electron-transferring agent precursor ETP-34-31, still another photographic material sample No. 403 was prepared. For comparison, a comparative sample No. 404 was prepared in the same manner as preparation of sample No. 401 except that the electron-transferring agent precursor was not added.

Next, a dye-fixing material (R-2) was prepared as follows.

10 g of poly(methyl acrylate-co-N,N,N-trimethyl-N-vinylbenzylammonium chloride) (in which the ratio of methyl acrylate to vinylbenzylammonium chloride was 1/1) was dissolved in 200 ml of water and then uniformly blended with 100 g of a 10% lime-processed gelatin. A hardening agent was added to the resulting blend, which was then evenly coated on a titanium dioxide dispersion-containing polyethylene-laminated paper support in a wet thickness of 90 μm. The thus prepared sample was dried and used as a dye-fixing material (R-2) having a mordant layer.

The previously prepared photographic material samples were exposed in the same manner as described in Example 1 and then uniformly heated on a heat block heated at 140° C. for 30 seconds.

Water was applied to the coated surface of the dye-fixing material (R-2) in an amount of 20 ml/m², and then the heated photographic material sample was attached to the wetted fixing material (R-2) with both surfaces facing each other.

Afterwards, the thus attached sample was passed through a laminater heated to 80° C. at a linear velocity of 12 mm/sec. Then both sheets were peeled away from each other, whereby a positive image with a good S/N ratio was formed on the dye-fixing material in every case.

Next, sample Nos. 401 to 404 were stored under the same conditions as described in Example 1 and then processed in the same manner as described above. As a result, the $D_{min}$ value in the image from sample No. 404 containing no electron-transferring agent precursor increased in an amount of 0.4 to 0.5 in every color of yellow, magenta and cyan. However, in the images from sample Nos. 401 to 403, the increase of the $D_{min}$ value was only 0.05 to 0.15. It is understood from these results that the combination of electron-transferring agent and electron-transferring agent precursor is effective for improving the raw stock stability of photographic materials.

While the invention has been described in detail and with reference to specific embodiments thereof, it will be apparent to one skilled in the art that various changes and modifications can be made therein without departing from the spirit and scope thereof.

What is claimed is:

1. A method for preparing an image from a heat-developable color photographic material comprising:
   1) placing a light-sensitive silver halide, a binder, at least one of a substantially immobile electron-donating agent and a precursor thereof, a reducible dye-forming compound which releases a diffusible dye by reduction, and simultaneously on a support, both a mobile electron-transferring agent and an electron-transferring agent precursor;
   2) imagewise exposing the heat-developable color photographic material; and
   3) heat-developing said photographic material.

2. The method of claim 1, wherein said electron-transferring agent is a compound represented by formula (X-I) or (X-II):

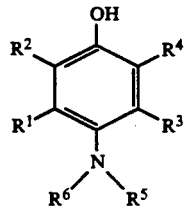

(X-I)

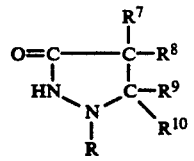

(X-II)

wherein R represents an aryl group; and $R^1$, $R^2$, $R^3$, $R^4$, $R^5$, $R^6$, $R^7$, $R^8$, $R^9$ and $R^{10}$, which may be the same or different, each represents a hydrogen atom, a halogen atom, a hydroxyl group, an acylamino group, an alkoxy group, an alkylthio group, an alkyl group, a substituted alkyl group, an aryl group or a substituted aryl group.

3. The method of claim 1, wherein the concentration of said electron-transferring agent by mole is from 0.001 to 4 times the concentration of said light-sensitive silver halide.

4. The method of claim 1, wherein the concentration of said electron-transferring agent by mole is from 0.003 to 0.5 times the concentration of said light-sensitive silver halide.

5. The method of claim 1, wherein said electron-transferring agent precursor is a compound represented by formula (W-I), (W-II) or (W-III):

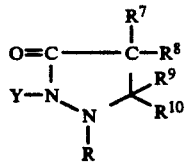

(W-I)

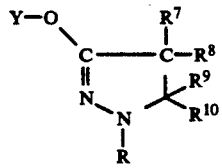

(W-II)

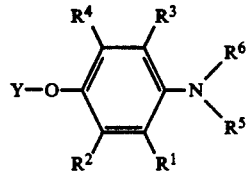

(W-III)

wherein R represents an aryl group; $R^1$, $R^2$, $R^3$, $R^4$, $R^5$, $R^6$, $R^7$, $R^8$, $R^9$ and $R^{10}$, which may be the same or different, each represents a hydrogen atom, a halogen atom, a hydroxyl group, an acylamino group, an alkoxy group, an alkylthio group, an alkyl group, a substituted alkyl group, an aryl group or a substituted aryl group; and Y represents a substituted alkyl group, an acyl group, an alkoxycarbonyl group, an aryloxycarbonyl group, a carbamoyl group, a substituted carbamoyl group, a sulfamoyl group, a substituted sulfamoyl group, a group having a formula as follows:

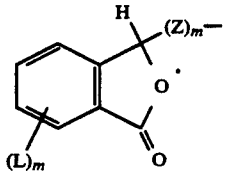

wherein Z represents a divalent linking group, bonded to the phthalide nucleus via an oxygen atom; L represents a halogen atom, an alkyl group, an alkenyl group, an aryl group, an alkoxy group, an aryloxy group, an acyloxy group, a carbonic acid ester group, an amino group, a carbonamido group, a sulfonamido group, an ureido group, an aminosulfonamido group, a carbamate group, a carboxyl group, an oxycarbonyl group, a carbamoyl group, an acyl group, a sulfo group, an alkylsulfonyl group, an arylsulfonyl group, a sulfamoyl group, a cyano group or a nitro group; and m represents 0 or 1, or a group having a formula as follows:

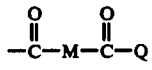

wherein M represents $$-(CH)_n- \text{ or } -\overset{R^{12}}{\underset{|}{C}}=\overset{R^{13}}{\underset{|}{C}}-;$$

n represents 2 or 3; $R^{11}$ represents a hydrogen atom, an alkyl group, a phenyl group, a halogen atom or an alkoxy group; $R^{12}$ and $R^{13}$, which may be the same or different, each represents a halogen atom, an alkyl group or a phenyl group, or $R^{12}$ and $R^{13}$ may be ring-closed to form a benzene ring; and Q represents a hydroxyl group $$-\overset{R^{14}}{\underset{|}{N}}-OR^{15} \text{ or } R^{16};$$

$R^{14}$ represents a hydrogen atom, an aryl group or an alkyl group; $R^{15}$ represents a hydrogen atom or an acyl group; and $R^{16}$ represents a hydrolyzable group.

6. The method of claim 1, wherein the concentration of said electron-transferring agent precursor by mole is from 0.01 to 20 times the concentration of said electron-transferring agent.

7. The method of claim 1, wherein the concentration of said electron-transferring agent precursor by mole is from 0.1 to 5 times the concentration of said electron-transferring agent.

8. The method of claim 1, wherein the decomposition speed of said electron-transferring agent precursor in said material is from 0.01 to 100 times the decomposition speed of said electron-transferring agent existing in said material.

9. The method of claim 1, wherein the decomposition speed of said electron-transferring agent precursor in said material is from 0.1 to 5 times the decomposition speed of said electron-transferring agent existing in said material.

10. The method of claim 1, wherein said at least one of electron-donating agent and a precursor thereof is a compound represented by formula (C) or (D):

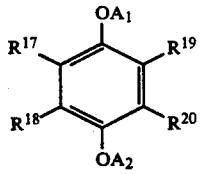

(C)

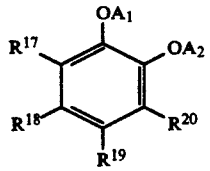

(D)

wherein $A_1$ and $A_2$, which may be the same or different, each represents a hydrogen atom or a protective group for a phenolic hydroxyl group capable of being deprotected by a nucleophilic agent; and $R^{17}$, $R^{18}$, $R^{19}$ and $R^{20}$, which may be the same or different, each represents a hydrogen atom, a substituted or unsubstituted alkyl group, a substituted or unsubstituted aryl group, a substituted or unsubstituted alkylthio group, a substituted or unsubstituted arylthio group, a substituted or unsubstituted aryl group, a substituted or unsubstituted alkylsulfonyl group, a sulfo group, a halogen atom, a cyano group, a substituted or unsubstituted carbamoyl group, a substituted or unsubstituted sulfamoyl group, a substituted or unsubstituted amido group, a substituted or unsubstituted imido group, a carboxyl group or a substituted or unsubstituted sulfonamido group, provided that the total number of carbon atoms in $R^{17}$ and $R^{18}$ and $R^{19}$ and $R^{20}$ is 8 or more; and at least one combination of $R^{17}$ and $R^{18}$, and $R^{19}$ and $R^{20}$ in formula (C), and at least one combination of $R^{17}$ and $R^{18}$, and $R^{19}$ and $R^{20}$ in formula (D) may be bonded to each other to form a saturated or unsaturated ring.

11. The method of claim 1, wherein said reducible dye-forming compound is a compound represented by formula (L):

$$PWR\text{-}(Time)_t\text{-}Dye \qquad (L)$$

wherein PWR represents a group capable of releasing $\text{-}(Time)_t\text{-}Dye$ by reduction; Time represents a group which releases Dye by the subsequent reaction, after having been released with PWR in the form of $\text{-}(Time)_t\text{-}Dye$; t represents 1 or 0; and Dye represents a dye or a precursor thereof.

12. The method of claim 1, wherein said reducible dye-forming compound is a compound represented by formula (L-II):

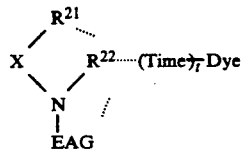

(L-II)

wherein $(Time)_t\text{-}Dye$ is bound to anyone of $R^{21}$, $R^{22}$ or EAG; X represents an oxygen atom, a sulfur atom or a nitrogen-containing group $-NR^{23}-$; $R^{21}$, $R^{22}$ and $R^{23}$, which may be the same or different, each represents a bond or a substituent other than hydrogen; and EAG represents an aromatic group which accepts an electron from a reducing substance.

13. The method of claim 12, wherein said reducible dye-forming compound is a compound represented by formula (L-III):

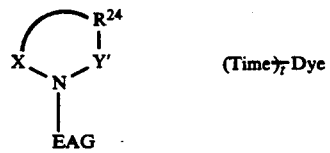

(L-III)

wherein $(Time)_t\text{-}Dye$ is bound to anyone of $R^{24}$ and EAG; $Y^1$ represents a divalent linking group; X and EAG have the same meanings as in claim 12; and $R^{24}$ represents an atomic group which is bonded to X and $Y^1$ to form a 5-membered to 8-membered monocyclic or condensed heterocyclic ring including nitrogen.

* * * * *